US005319419A

United States Patent [19]

Ishida et al.

[11] Patent Number: 5,319,419

[45] Date of Patent: Jun. 7, 1994

[54] SCANNING SYSTEM DRIVING DEVICE

[75] Inventors: Hideki Ishida, Yao; Mitsugu Miyamoto, Moriguchi; Shoichi Kitagawa, Neyagawa; Takashi Nagashima, Habikino; Daisuke Hayashi, Hirakata; Hiroshi Kusumoto, Wakayama, all of Japan

[73] Assignee: Mita Industrial Co., Ltd., Osaka, Japan

[21] Appl. No.: 982,769

[22] Filed: Nov. 27, 1992

[30] Foreign Application Priority Data

| | | | |
|---|---|---|---|
| Nov. 27, 1991 | [JP] | Japan | 3-312606 |
| Nov. 27, 1991 | [JP] | Japan | 3-312607 |
| Nov. 27, 1991 | [JP] | Japan | 3-312608 |
| Nov. 27, 1991 | [JP] | Japan | 3-312609 |

[51] Int. Cl.[5] ..... G03G 15/28

[52] U.S. Cl. ..... 355/235; 355/208; 355/233

[58] Field of Search ..... 355/204, 208, 228, 233, 355/235, 236, 67

[56] References Cited

U.S. PATENT DOCUMENTS

| | | | |
|---|---|---|---|
| 4,287,461 | 9/1981 | Promis et al. | 355/235 X |
| 4,540,927 | 9/1985 | Tanimoto | 355/235 X |
| 4,586,808 | 5/1986 | Tanimoto et al. | 355/235 |
| 4,595,281 | 6/1986 | Oushida et al. | 355/233 X |
| 4,600,293 | 7/1986 | Watanabe | 355/235 |
| 4,649,437 | 3/1987 | Watanabe | 355/235 X |
| 4,891,669 | 1/1990 | Hiroki | 355/235 |
| 5,089,902 | 2/1992 | Tsubota | 355/235 X |
| 5,221,974 | 6/1993 | Kusumoto et al. | 355/235 X |

FOREIGN PATENT DOCUMENTS

| | | | |
|---|---|---|---|
| 0173856 | 10/1982 | Japan | 355/235 |
| 0212466 | 12/1982 | Japan | 355/235 |
| 0122562 | 7/1983 | Japan | 355/235 |
| 0148439 | 7/1986 | Japan | 355/235 |
| 0050076 | 2/1989 | Japan | 355/235 |

*Primary Examiner*—Matthew S. Smith

*Attorney, Agent, or Firm*—Antonelli, Terry, Stout & Kraus

[57] ABSTRACT

A scanning system driving device capable of quickly and gently starting a scanning system. This driving device includes an electromagnetic clutch for forward rotation, for transmitting a driving force from a driving source to a moving body for an optical system, and a control circuit for controlling the application of a voltage to the electromagnetic clutch. The control circuit applies a rated voltage in the form of pulses to the electromagnetic clutch at intervals of such OFF time that the moving speed of the moving body is reduced once when the illumination and the scanning of a document by the moving body are started.

58 Claims, 11 Drawing Sheets

SCANNING SYSTEM DRIVING DEVICE

BACKGROUND OF THE INVENTION

1. Field of the Invention

The present invention relates generally to a scanning system driving device used in an image forming apparatus, having a scanning system for illuminating and scanning a document, such as a copying machine or an image scanner, and more particularly, to an improvement in transmission control of a driving force of the scanning system driving device.

As a scanning system provided for a copying machine or the like, there are two types of scanning systems: a scanning system in which an optical system is moved relative to a still document, and a scanning system in which a document platen is moved relative to a still optical system. In this specification, the term "scanning system" is used as a general term for the above described two types of scanning systems. Consequently, a scanning system driving device includes both a device for moving and controlling an optical system and a device for moving and controlling a document platen.

2. Description of the Prior Art

An image forming apparatus such as a copying machine includes a scanning system for optically scanning a document by driving an optical system or a document platen. For example, in a copying machine comprising a scanning system in which an optical system is driven, a moving body holding a light source and a reflecting mirror is displaced at uniform speed relative to a document. Consequently, the surface of the document is illuminated and scanned. In the process, a photoreceptor is exposed by light reflected from the document, and an electrostatic latent image is formed on the surface of the photoreceptor. This electrostatic latent image is developed into a toner image, and the toner image is transferred and fixed to copy paper, to achieve copying.

In such an image forming apparatus such as a copying machine, there are strong demands toward improvements in the image quality, along with miniaturization and higher speed. Therefore, improvements have been made for shortening the rise time elapsed before the scanning speed of the document by the scanning system reaches a predetermined speed, as well as preventing the nonuniformity of speed from occurring during the scanning of the document.

The electrostatic latent image formed on the surface of the photoreceptor is formed by the light reflected from the document illuminated and scanned. In order to increase the copying speed, therefore, it is essential that the scanning system be moved at high speed. Furthermore, in order to accurately reproduce a document image, it is necessary to keep the scanning speed constant.

On the other hand, if the copying machine is miniaturized, the moving distance of the scanning system from the home position to the position where illumination and scanning are started is short. Therefore, it is necessary to rapidly increase the moving speed of the scanning system. If the moving speed of the scanning system is thus rapidly increased so-called overshoot is produced. That is, the speed of the scanning system once exceeds the rated speed immediately before the speed of the scanning system reaches the rated speed. This overshoot degrades the copy image corresponding to the region in the vicinity of the position where illumination and scanning are started. Consequently, care must be taken to exclude the effect of the overshoot.

A prior art technique in which the moving speed of a scanning system is rapidly increased and a copy image is not affected by overshoot is shown in FIG. 11. A driving force on the scanning system is supplied from a main motor, provided in the copying machine, through an electromagnetic clutch. FIG. 11(*a*) shows the change with time of the voltage applied to the electromagnetic clutch, and FIG. 11(*b*) shows the change with time of the moving speed of the scanning system.

In this prior art technique, in order to rapidly increase the moving speed of the scanning system, the voltage applied to the electromagnetic clutch is instantaneously increased to a predetermined rated voltage at the time of starting the scanning system, as shown in FIG. 11(*a*). This predetermined rated voltage is a voltage applied to the electromagnetic clutch when the scanning system is driven at rated speed so as to illuminate and scan a document. In FIG. 11, an idle period is a period elapsed from the time when the rotation of the main motor is started until the electromagnetic clutch is connected, an approach period is a period elapsed from the time when the scanning system is in the home position until it reaches the position where illumination and scanning are started, and an image forming period is a period during which the document is illuminateded and scanned.

In this prior art technique the electromagnetic clutch is instantaneously connected, so that the driving force from the main motor is impulsively transmitted to the scanning system. Immediately after the scanning system rises, therefore, the moving speed of the scanning system fluctuates, as shown in FIG. 11(*b*). If the moving speed vibrates, excellent image formation is not carried out. Consequently, a period during which the moving speed vibrates is taken as an approach period, and a period after the moving speed is stabilized is taken as an image forming period.

In this prior art technique, however, it is necessary to ensure a sufficient approach period to stabilize the moving speed of the scanning system. Therefore, the distance from the home position to the position where illumination and scanning are started of the scanning system, that is, an approach distance, is increased. Therefore, there occurs a problem that the copying machine is prevented from being miniaturized.

This problem is solved by another prior art technique shown in FIG. 12. In this prior art technique a applied to an electromagnetic clutch is gradually increased, as shown in FIG. 12(*a*), Therefore, a driving force from a main motor is gently transmitted to a scanning system. As a result, the moving speed of the scanning system is smoothly increased and stabilized at rated speed in a short time, as shown in FIG. 12(*b*). Consequently, no long approach distance is required, thereby making it possible to miniaturize the copying machine, unlike the prior art technique shown in FIG. 11.

In this prior art technique however, a dedicated electric circuit of complicated construction is required to gradually increase the voltage applied to the electromagnetic clutch. Therefore, there occurs a new problem in that the cost is increased.

Still another prior art technique by which this problem is solved is disclosed in Japanese Patent Laid-Open Gazette No. 148138/1986. This gazette discloses the technique for applying a pulse voltage to an electromagnetic clutch in the early stages of scanning and repeatedly connecting and/or disconnecting the clutch to achieve a substantially half clutched state. In this prior art technique, however, the pulse period, the pulse content and the like of the pulse voltage are not sufficiently considered. That is, the natural vibration of an optical system is promoted by repeatedly connecting and/or disconnecting the clutch, so that the image quality is liable to be degraded.

SUMMARY OF THE INVENTION

An object of the present invention is to provide a scanning system driving device which does not have vibration immediately after the rise of a scanning system, while decreasing the approach distance of the scanning system.

In the present invention, a rated voltage is applied in the form of pulses to an electromagnetic clutch for transmitting a driving force from a driving source to a scanning system at intervals of such OFF time that the connecting force of the electromagnetic clutch is decreased to reduce the rising speed of the scanning system once at the time of starting scanning by the scanning system.

In this construction, the electromagnetic clutch is brought into a half connected state from a disconnected state, and the connecting force of the electromagnetic clutch is repeatedly increased and/or decreased in this half connected state. That is, the electromagnetic clutch is not repeatedly connected and/or disconnected. As a result, the scanning system can be gently started. Moreover, the moving speed of the scanning system can be quickly stabilized. Consequently, the approach distance of the scanning system is decreased. Moreover, the fluctuation of the moving speed of the scanning system can be restrained.

Furthermore, if such a pulse voltage that the above described conditions are satisfied in conformity with an electromagnetic clutch is applied, the effect of the difference in the connecting force between a plurality of electromagnetic clutches can be excluded to reduce the fluctuation of the moving speed of the scanning system.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 4 (*b*) is a diagram showing the state of the electromagnetic clutch at the time of reverse rotation;

FIG. 6 (*b*) is a diagram showing the change with time of the moving speed of the scanning system at the time of starting the scanning system in the first embodiment of the present invention:

FIG. 7 (*b*) is a diagram showing the change with time of the moving speed of the scanning system at the time of starting the scanning system in the second embodiment of the present invention;

FIG. 8 (*b*) is a diagram showing the change with time of the moving speed of the scanning system at the time of starting the scanning system in the third embodiment of the present invention;

FIG. 9 (*b*) is a diagram showing the change with time of the moving speed of the scanning system at the time of starting the scanning system in the fourth embodiment of the present invention;

FIG. 10 (*b*) is a diagram showing the change with time of the moving speed of the scanning system at the time of starting the scanning system in the fifth embodiment of the present invention;

DESCRIPTION OF THE PREFERRED EMBODIMENTS

Figure 1:
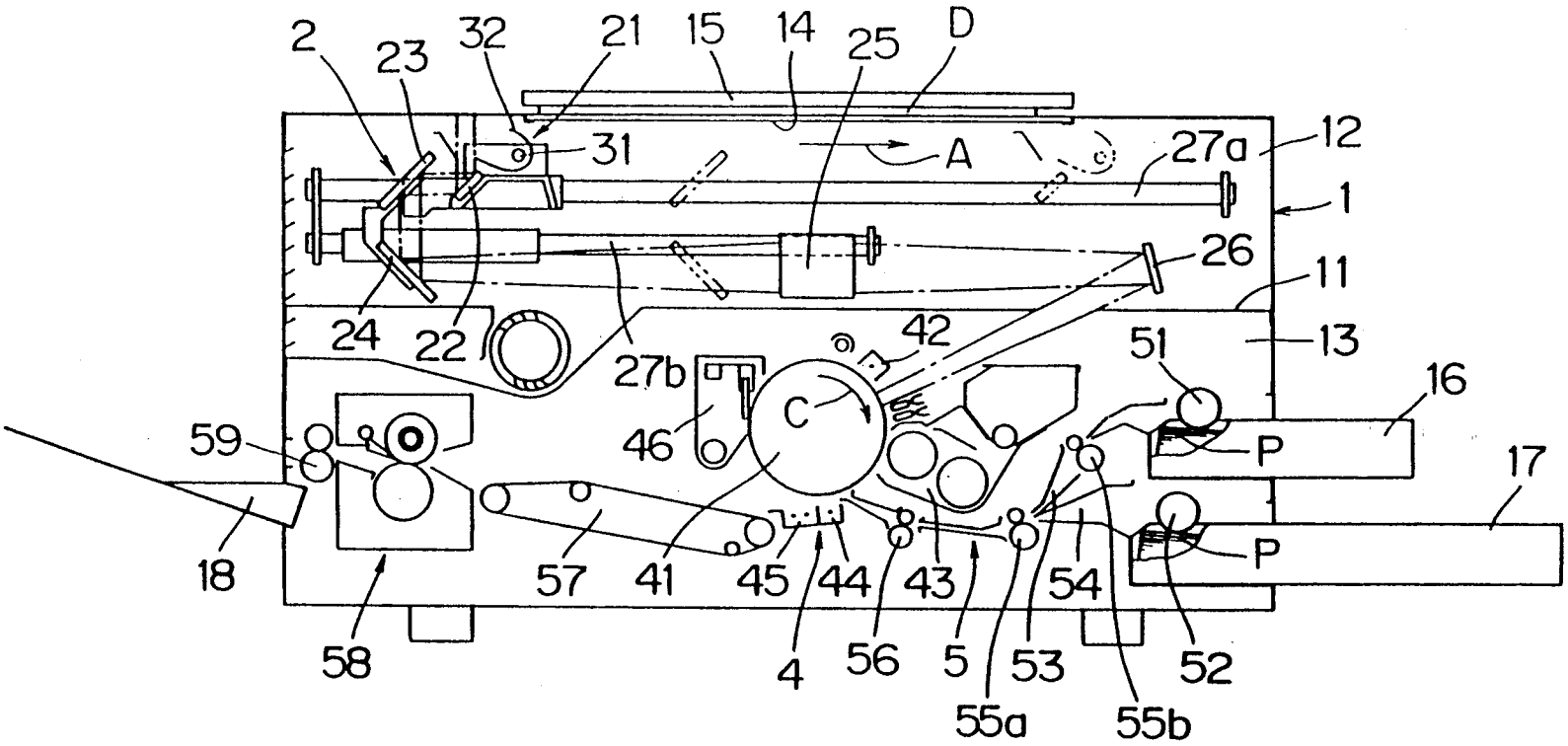
FIG. 1 is a schematic diagram illustrating the internal construction of a copying machine to which an embodiment of the present invention is applied.

FIG. 1 is a conceptual diagram illustrating the internal construction of a copying machine to which a scanning system driving device according to an embodiment of the present invention is applied. An internal space within a main body 1 of the copying machine is partitioned into an upper casing 12 and a lower casing 13 by a partitioning plate 11. In the upper casing 12, there is provided an optical system 2, having a predetermined inertial mass, which is a scanning system for illuminating and scanning a document. In the lower casing 13, there are provided a copying section 4, for forming a copy image on copy paper P, and a copy paper conveying section 5.

The optical system 2 comprises a light source 21 constituted by an illuminant 31 and a main reflector 32, first, second and third reflecting mirrors 22, 23 and 24, a lens 25, and a fourth reflecting mirror 26. The optical system 2 is so constructed that a document D on a document platen 14, constituted by a transparent platen or the like, can be illuminated and scanned by moving the light source 21 and the first to third reflecting mirrors 22, 23 and 24 in the direction indicated by an arrow A along guide shafts 27*a* and 27*b* and a guide rail (not shown). When the optical system 2 is moved, however, the light source 21 and the first reflecting mirror 22 integrally reciprocate, and the second reflecting mirror 23 and the third reflecting mirror 24 integrally reciprocate.

The copy paper conveying section 5 comprises paper feeding rollers 51 and 52, paper feeding paths 53 and 54, delivery rollers 55*a* and 55*b*, a registration roller 56, a delivery belt 57, a heating and fixing roller 58, and a discharge roller 59. The copy paper conveying section 5 is so constructed as to selectively drive the paper feeding rollers 51 and 52 to take out the copy paper P from a paper feeding cassette 16 or 17, introduce the copy paper P into the copying section 4 to transfer a toner image, heat and fix the toner image by the heating and fixing roller 58 and then, discharge the copy paper P onto a discharge tray 18. The copy paper conveying section 5 is not limited to this construction. For example, it is possible to also use a copy paper conveying section of another construction conventionally known, for example, such construction that paper is fed and discharged on the same side.

The copying section 4 is constructed by arranging a charging corona discharger 42, a developing device 43, a transferring corona discharger 44, a separating corona discharger 45 and a cleaner 46 in this order around a photosensitive drum 41 rotated in the direction indicated by an arrow C. The copying section 4 is so constructed as to form a document image on the outer surface of the photosensitive drum 41 uniformly charged by the charging corona discharger 42 to form an electrostatic latent image and then, develop the electrostatic latent image into a toner image by the developing device 43, and transfer the toner image onto the copy paper P by the transferring corona discharger 44. Toner remaining on the surface of the photosensitive drum 41, after the toner image is transferred, is recovered by the cleaner 46. The copying section is not limited to this construction. For example, it is possible to also use a copying section of another construction conventionally known, for example, a copying section using a photoreceptor in a belt shape.

Figure 2:
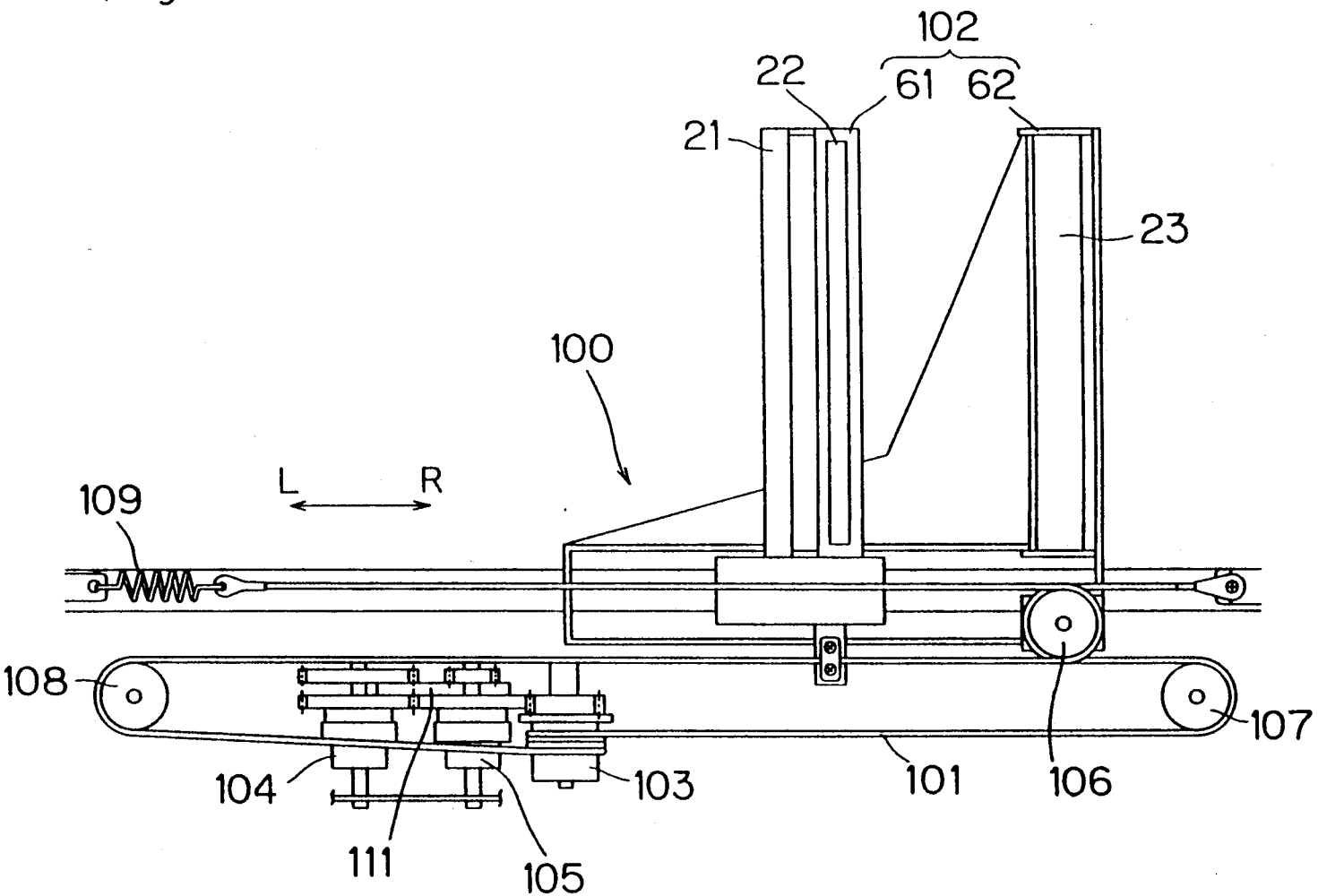
FIG. 2 is a plan view illustrating the construction of a scanning system driving device.

FIG. 2 is a plan view illustrating in detail the construction of a scanning system driving device. A driving device 100 comprises a driving wire 101 stretched between scanning regions, a moving body 102 mounted at a predetermined position of the driving wire 101 and holding respective components of the optical system 2, a wire-wound drum 103 around which the driving wire 101 is wound, an electromagnetic clutch for forward rotation 104 for transmitting a driving force to the wire-wound drum 103 to rotate the drum 103 in the forward rotation to move the moving body 102 in the direction L, and an electromagnetic clutch for reverse rotation 105 for transmitting the driving force to the wire-wound drum 103 to rotate the drum 103 in the reverse direction to move the moving body 102 in the direction R.

A micro clutch BH-3-A01 manufactured by Shinko Electric Co., Ltd., for example, is used for the electromagnetic clutch for forward rotation 104 and the electromagnetic clutch for reverse rotation 105. The major specifications of the micro clutch are as follows.

| | |
|---|---|
| Rated input voltage | DC24V ± 10% |
| Rated input current | 0.175 A |
| Static friction torque | 3 kgfcm or more |
| Load torque | 0.46 kgfcm |

The moving body 102 comprises a first mirror box 61, for supporting a light source 21 and a first reflecting mirror 22, and a second mirror box 62, for supporting a second reflecting mirror 23 and a third reflecting mirror 24 (see FIG. 1). The moving body 102 is fixed at a predetermined position of the driving wire 101 on the side of the first mirror box 61. In addition, the moving body 102 is provided with a guide pulley 106 on the side of the second mirror box 62.

The driving wire 101 is fixed to the end of the scanning region in the direction R in its end, in its end, is wound around a guide pulley 106 on the moving body 102, is wound around a pulley 107, is wound around the wire-wound drum 103 a plurality of times, is further wound around a pulley 108, is again wound around the guide pulley 106, and is fixed through a spring 109 to the other end of the scanning region in the direction L.

With this construction, if the wire-wound drum 103 is rotated, the first mirror box 61 is moved in the directions L and R, and the second mirror box 62 is moved to the directions L and R at speed which is one-half of the moving speed of the first mirror box 61.

The electromagnetic clutch for forward rotation 104 (FIG. 4) comprises a clutch gear 112, which is meshed with a driving gear 111 connected to a main motor 110 (see FIG. 5) and is always rotated, and a driven gear 113, which is provided on the same shaft with the clutch gear 112 and can be rotated independently from the clutch gear 112. The electromagnetic clutch for forward rotation 104 is so constructed as to attract the driven gear 113 toward the clutch gear 112 by an electromagnetic coil (not shown) contained therein to bring the driven gear 113 into frictional contact with the clutch gear 112 through a suitable friction plate (not shown) and transmit the driving force applied to the clutch gear 112 to the driven gear 113 by the frictional force.

On the other hand, the electromagnetic clutch for reverse rotation 105 comprises a clutch gear 114, which is meshed with the driving gear 111 connected to the main motor 110 and is always rotated, and a driven gear 115 which is provided on the shaft of the clutch gear 114 and can be rotated independently from the clutch gear 114. The electromagnetic clutch for reverse rotation 105 is so constructed as to attract the driven gear 115 toward the clutch gear 114 by an electromagnetic coil (not shown) contained therein to bring the driven gear 115 into frictional contact with the clutch gear 114 through a suitable friction plate (not shown) and transmit a driving force applied from the clutch gear 114 to the driven gear 115 by the frictional force.

Figure 4A:
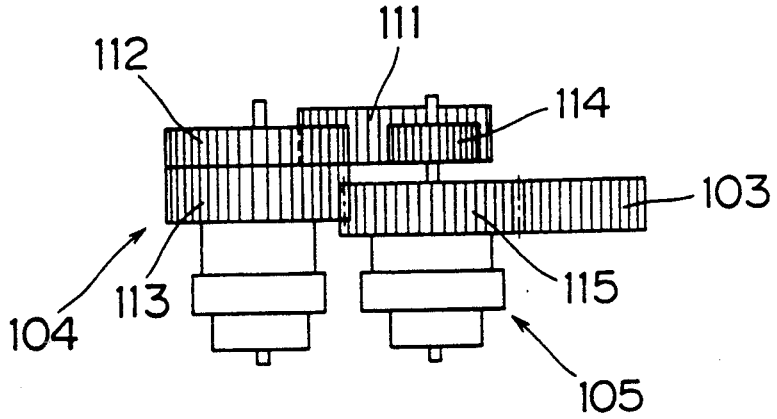
FIG. 4 (*a*) is a diagram showing the state of an electromagnetic clutch at the time of forward rotation.
Figure 4B:
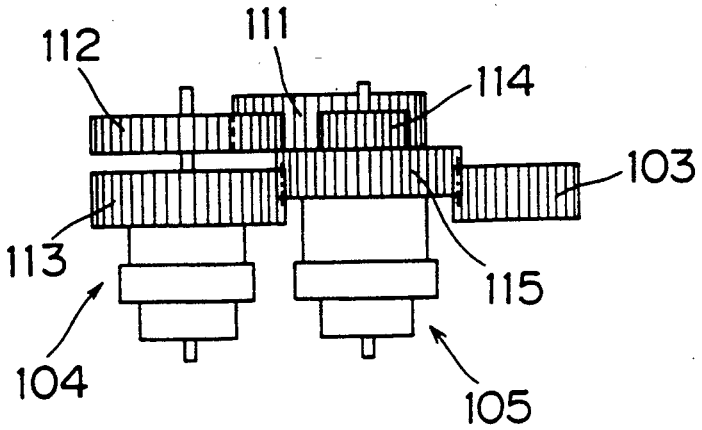

Furthermore, the driven gear 113 in the electromagnetic clutch for forward rotation 104 is meshed with the driven gear 115 in the electromagnetic clutch for reverse rotation 105, and the driven gear 115 is meshed with the wire-wound drum 103, as shown in FIG. 4.

The electromagnetic clutch for forward rotation 104 and the electromagnetic clutch for reverse rotation 105 respectively have connecting forces which vary depending on the magnitude of the average applied voltage per unit time until the clutch is brought into a completely connected state. The electromagnetic clutches 104 and 105 can be brought into a half connected state, which is an intermediate state between a disconnected state and a completely connected state, depending on the relationship among the connecting force, the inertial mass of the optical system 2 and the driving force from the main motor 110. The disconnected state is a state where the driving force from the main motor 110 is not entirely transmitted to the moving body 102. On the other hand, the completely connected state is a state where the driving force from the main motor 110 is directly transmitted to the moving body 102.

Figure 3:
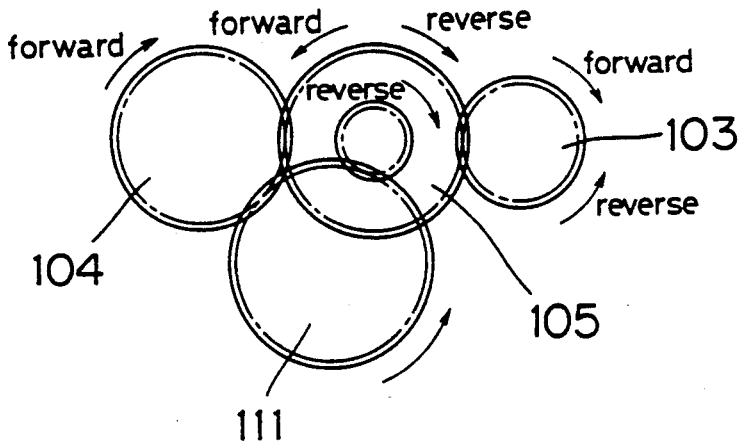
FIG. 3 is a diagram showing the gears in the driving device meshed with each other.

Either one of the electromagnetic clutch for forward rotation 104 and the electromagnetic clutch for reverse rotation 105 is selected to be brought into a connected state, thereby to make it possible to perform a forward rotation operation or a reverse rotation operation as shown in FIG. 3. More specifically, as shown in FIG. 4 (*a*), if the electromagnetic clutch for forward rotation 104 is brought into a connected state, while the electromagnetic clutch for reverse rotation 105 is not, torque from the clutch gear 112 is transmitted to the driven gear 113, and is further transmitted to the wire-wound drum 103 through the driven gear 115 which is in a freely rotated state. Accordingly, the wire-wound drum 103 is rotated in the direction of forward rotation as shown in FIG. 3. As a result, the first mirror box 61 and the second mirror box 62 are driven in the direction L as shown in FIG. 2. On the other hand, as shown in FIG. 4 (*b*), if the electromagnetic clutch for reverse rotation 105 is brought into a connected state, while the electromagnetic clutch for forward rotation 104 is not, torque from the clutch gear 114 is transmitted to the wire-wound drum 103 from the driven gear 115. At this time, the driven gear 113 meshed with the driven gear 115 only follows the rotation of the driven gear 115. Therefore, the wire-wound drum 103 is rotated in the direction of reverse rotation shown in FIG. 3. As a result, the moving body 102 is driven in the direction R shown in FIG. 2.

A clutch gear having a smaller number of teeth than those of the clutch gear for forward rotation 112 is applied to the clutch gear for reverse rotation 114, thereby to perform at high speed the return operation at high speed when the first mirror box 61 and the second mirror box 62 have terminated scanning for image formation and are returned to the home position.

Figure 5:
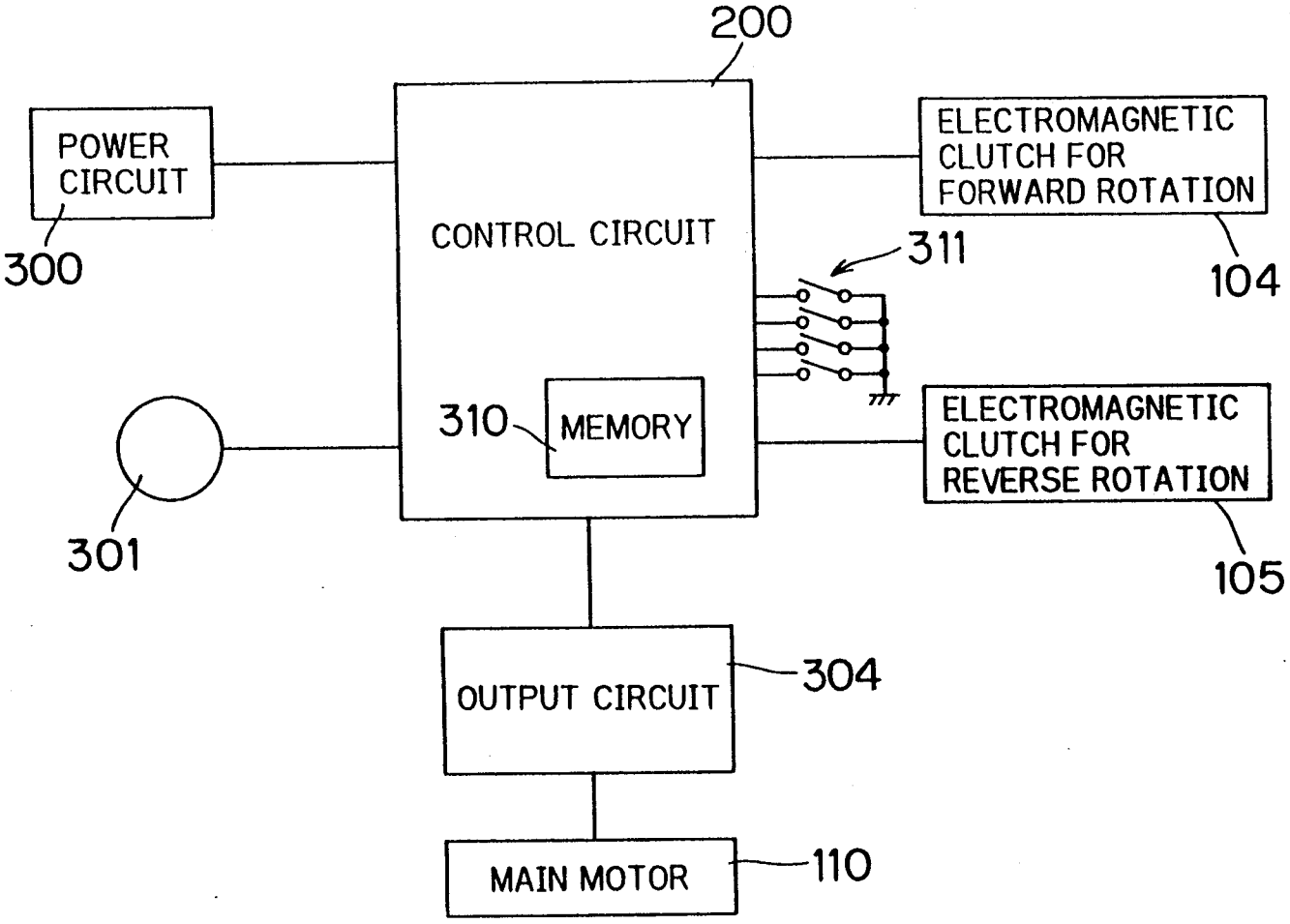
FIG. 5 is a block diagram of the scanning system driving device.

FIG. 5 is a functional block diagram showing the electrical components for controlling the above described driving device. The connection and the disconnection of both the electromagnetic clutches 104 and 105 are controlled by a control circuit 200. Operating power of the control circuit 200 is produced in a power circuit 300. A print switch 301, for initiating the start of a copying operation, and an output circuit 304, for turning on and/or off the main motor 110, are further connected to the control circuit 200.

The power circuit 300 generates a rated voltage to be applied to the electromagnetic clutches 104 and 105. This rated voltage is a voltage which is continuously applied to the electromagnetic clutches 104 and 105 over not less than a predetermined time to allow the electromagnetic clutches 104 and 105 to be brought into a completely connected state. The application of the rated voltage is controlled by the control circuit 200.

Figure 6A:
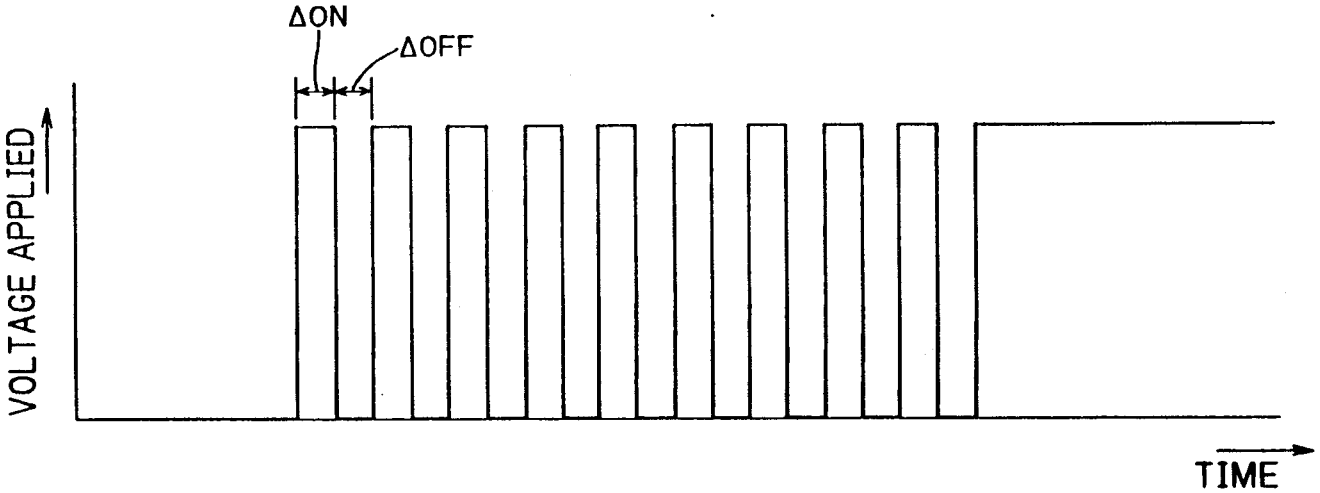
FIG. 6 (*a*) is a waveform diagram showing a voltage applied to the electromagnetic clutch at the time of starting a scanning system in a first embodiment of the present invention.
Figure 6B:
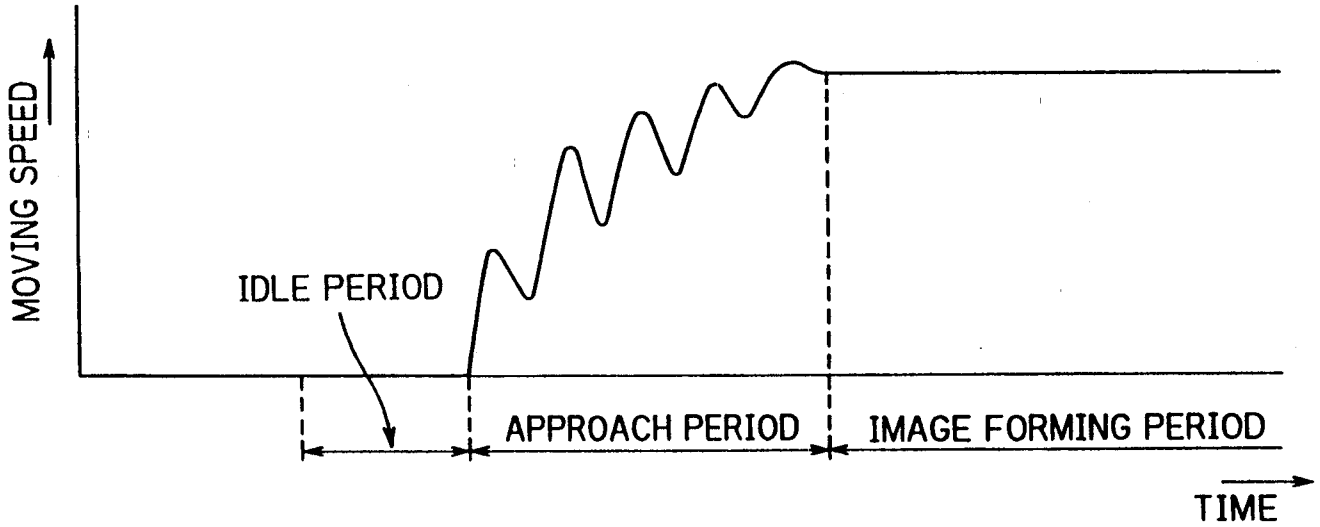

FIG. 6 (*a*) is a waveform diagram showing a waveform of a voltage applied to the electromagnetic clutch for forward rotation 104 by the control circuit 200 in the early stages of scanning, and FIG. 6 (*b*) is a diagram showing the change with time of the moving speed of the moving body 102 (the first mirror box 61). If the print switch 301 is turned on, an operation signal from the print switch 301 is inputted to the control circuit 200. The control circuit 200 energizes the main motor 110 through the output circuit 304 in response to the operation signal. In addition, the control circuit 200 applies a pulse voltage to the electromagnetic clutch for forward rotation 104 during at least an approach period extending from the time when the moving body 102 is in the home position to the time when body 102 has reached the position where illumination and scanning are started.

More specifically, as shown in FIG. 6 (*a*), the control circuit 200 applies a pulse voltage having constant ON time $\Delta_{ON}$ to the electromagnetic clutch for forward rotation 104 at intervals of OFF time $\Delta_{OFF}$ by switching the above described rated voltage generated by the power circuit 300. The OFF time $\Delta_{OFF}$ is a time such that the connecting force of the electromagnetic clutch for forward rotation 104 can be decreased to reduce the moving speed of the moving body 102 once. This OFF time $\Delta_{OFF}$ may be a constant value or a value varying depending on the passage of time or the position of the moving body 102. A pulse waveform shown in FIG. 6 (*a*) is one example. In this example, the OFF time $\Delta_{OFF}$ is 5 msec and is constant. In addition, the ON time $\Delta_{ON}$ is 5 msec. Such a pulse voltage is continuously applied only for a period of, for example, nine pulses. It is preferable that the ON time $\Delta_{ON}$ be not more than 30 msec so that the electromagnetic clutch for forward rotation 104 is not brought into a completely connected state instantaneously by application of one pulse.

As shown in FIG. 6 (*b*), therefore the moving speed of the moving body 102 is gradually increased without causing so large a fluctuation, and can be stabilized at the rated speed at the end of the approach period. As a result, the moving body 102 can be gently started in the direction L shown in FIG. 2.

It is preferable to determine the ON time $\Delta_{ON}$ and the OFF time $\Delta_{OFF}$ so that the fluctuation of the moving speed of the moving body 102 is such as to restrain the natural vibration of the optical system 2 in consideration of, for example, the gear pitches of the clutch gear 112 and the driven gear 113. Consequently, the natural vibration of the optical system 2 can be restrained, thereby making it possible to improve the image quality.

In an image forming period after the moving body 102 has reached the position where illumination and scanning are started at a predetermined moving speed, the control circuit 200 continuously applies a rated voltage to the electromagnetic clutch for forward rotation 104. Consequently, the moving body 102 is moved at a uniform speed by the driving force obtained from the main motor 110. If the moving body 102 reaches the terminal position in the direction L, the electromagnetic clutch for forward rotation 104 is turned off, and the control circuit 200 continuously applies the rated voltage to the electromagnetic clutch for reverse rotation 105. Consequently, the moving body 102 is moved at uniform speed in the direction R (see FIG. 2) to perform a return operation.

At the end of the return operation, the moving body 102 reaches the approach region again through the image forming region. At this time, the control circuit 200 applies a predetermined pulse voltage to the electromagnetic clutch for reverse rotation 105. This pulse voltage is such a voltage that the connecting force between the clutch gear 114 in the electromagnetic clutch for reverse rotation 105 and the driving gear 111 can be gradually decreased. Consequently, the moving body 102 is smoothly decelerated, to be stopped in the home position. Thereafter, the control circuit 200 turns the main motor 110 off through the output circuit 304.

As described in the foregoing, according to the present invention, at the time of starting the scanning system, the pulse voltage having constant ON time is continuously applied to the electromagnetic clutch for forward rotation 104 at intervals of such OFF time that the connecting force of the electromagnetic clutch 104 can be decreased to reduce the speed of the moving body 102 once. More specifically, the pulse voltage is applied to the electromagnetic clutch 104 to gradually increase the connecting force of clutch 104 by repeating increase and decrease. Therefore, the driving force is gradually transmitted to the moving body 102 to allow the moving speed of the moving body 102 to smoothly increase. An amount of slip between the pair of friction plates of the electromagnetic clutch for forward rotation 104 is decreasing as the moving speed of the moving body 102 is increasing. Thus, the moving speed of the moving body 102 can be increased to the rated speed over a short approach distance and stabilized. Consequently, the scanning system driving device according to the present embodiment is favorable for miniaturization of the copying machine and can prevent degradation of an image. Moreover, no such complicated circuit as to continuously change the voltage applied to the electromagnetic clutch is required, so that the construction is not complicated and the cost is not excessively increased.

On the other hand, the scanning system driving device can be so constructed that a memory 310 (see FIG. 5), storing a plurality of types of waveforms of a pulse voltage applied to the electromagnetic clutch for forward rotation 104 or the electromagnetic clutch for reverse rotation 105, is provided for the control circuit 200, and each of the pulse waveforms is selected by, for example, a dip switch 311 (see FIG. 5). I this construction is adopted, it is possible to set the dip switch 311 to select at the time of shipment of products a pulse waveform corresponding to the performance of the electromagnetic clutch 104 or 105 used for each of the products to set dip switch 311 to and select at the time of maintenance the pulse waveform corresponding to the performance of the electromagnetic clutch 104 or 105 as changed with time. Consequently, the rise characteristics of the moving speed of the moving body 102 is inhibited from varying due to differences in performance between electromagnetic clutches used as clutch.

Meanwhile, the pulse waveform can be stored by storing a waveform itself. When both the ON time $\Delta_{ON}$ and the OFF time $\Delta_{OFF}$ are respectively made constant, however, a plurality of types of ON time $\Delta_{ON}$ and OFF time $\Delta_{OFF}$ may be stored. In addition, the pulse waveform may be selected by an operation of a section other than the dip switch 311, for example, a keying section provided for the copying machine.

A second embodiment of the present invention will be described. Description is made by again referring to FIGS. 1 to 5 described above and further referring to FIG. 7.

Figure 7A:
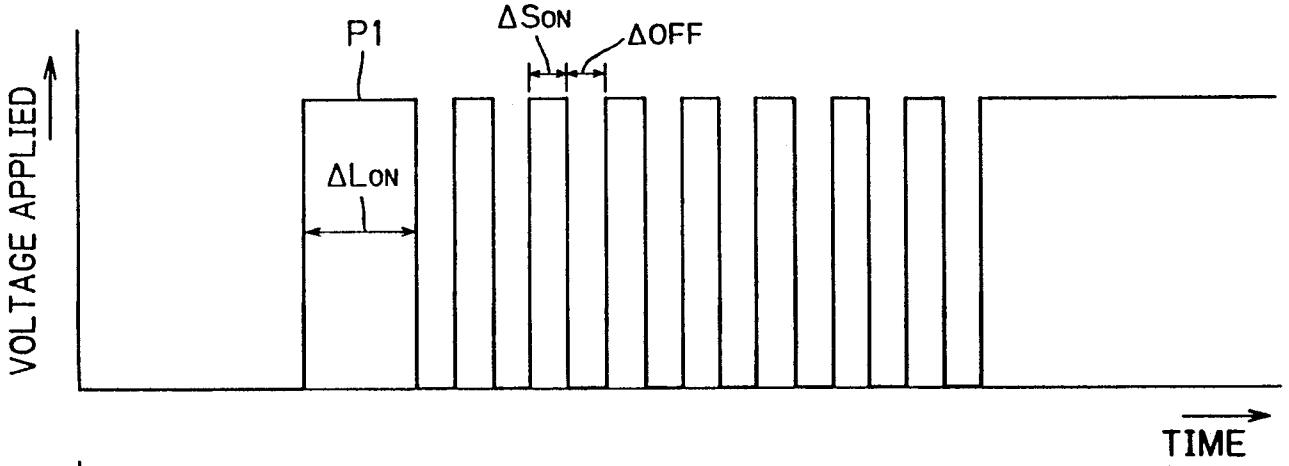
FIG. 7 (*a*) is a waveform diagram showing a voltage applied to an electromagnetic clutch at the time of starting a scanning system in a second embodiment of the present invention.
Figure 7B:
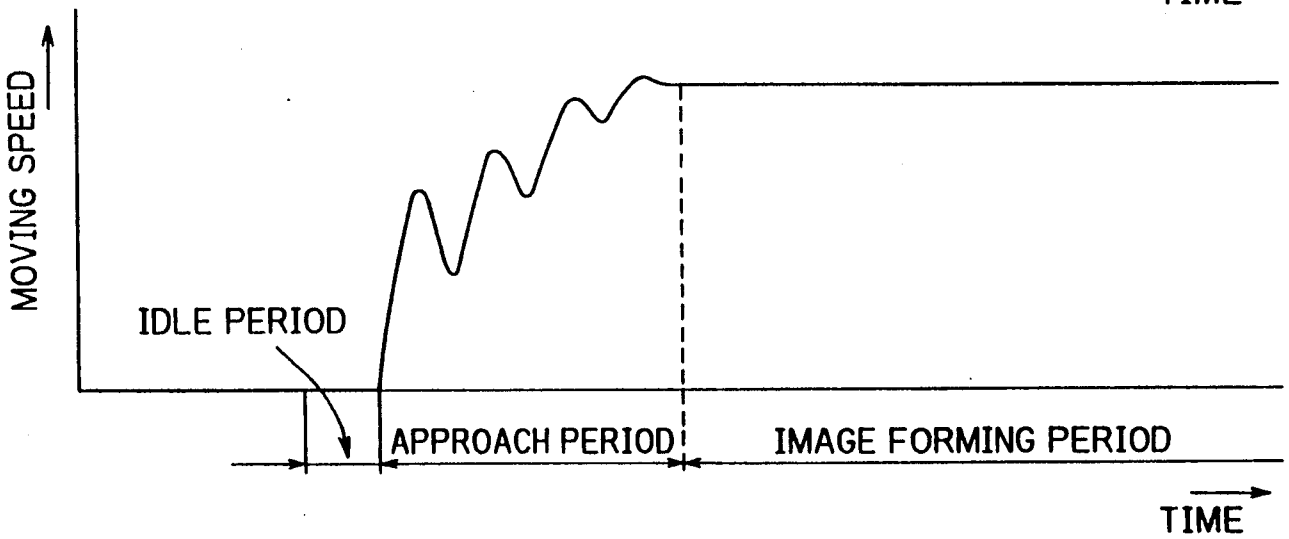

FIG. 7(*a*) is a waveform diagram showing a waveform of a voltage applied to the electromagnetic clutch for forward rotation 104 by the control circuit 200 in the early stages of the movement of the moving body 102, and FIG. 7(*b*) is a diagram showing the change with time of the moving speed of the moving body 102.

When an operator turns the print switch 301 on, an operation signal from the print switch 301 is inputted to the control circuit 200. The control circuit 200 turns the main motor 110 on through the output circuit 304 in response to the operation signal, and further applies a pulse voltage to the electromagnetic clutch for forward rotation 104 over a period extending until the moving body 102 reaches the position where illumination and scanning are started.

More specifically, as shown in FIG. 7(*a*), in a period from an idle period to the early stages of an approach period, a first pulse P1, having, relatively long ON time $\Delta L_{ON}$, is applied to the electromagnetic clutch for forward rotation 104. Thereafter, a pulse voltage having constant ON time $\Delta S_{ON}$, relatively shorter than the ON time $\Delta L_{ON}$ of the first pulse P1, is applied to the electromagnetic clutch for forward rotation 104 at intervals of OFF time $\Delta_{OFF}$. The OFF time $\Delta_{OFF}$ is such time that the connecting force of the electromagnetic clutch for forward rotation 104 can be decreased to reduce the increasing speed of the scanning system once. The OFF time $\Delta_{OFF}$ may be a constant value or a value varying depending on the passage of time and the position of the moving body 102. The pulse waveform shown in FIG. 7(*a*) is one example. In this example, the OFF time $\Delta_{OFF}$ is 5 msec and is constant. In addition, the ON time $\Delta S_{ON}$ is 5 msec. Such a pulse voltage is continuously applied only for a period of, for example, seven pulses.

The ON time $\Delta L_{on}$ of the first pulse P1 is so set that a clearance between friction surfaces of the clutch gear 112 and the driven gear 113 is reduced down to zero and the connecting force between the clutch gear 112 and the driven gear 113 is 20 to 50 per cent of the maximum value of the connecting force.

Consequently, the clearance between the friction surfaces of the clutch gear 112 and the driven gear 113 in the electromagnetic clutch for forward rotation 104 is first reduced down to zero by a pulse voltage corresponding to the first pulse P1. Thereafter, the pulse voltage having relatively short ON time $\Delta S_{ON}$ is applied to the electromagnetic clutch for forward rotation 104, thereby to make it possible to gently start the moving body 102 without causing so large a fluctuation of the moving speed of the moving body 102. The moving speed of the moving body 102 can be increased to the rated speed a relatively short approach distance and stabilized.

The clearance between the clutch gear 112 and the driven gear 113 in the electromagnetic clutch 104 is reduced instantaneously by the application of the first pulse P1, thereby not only to shortening the approach period but also shortening the idle period. In addition, the behavior of the moving body 102 in the approach period is effectively inhibited from varying due to differences in attraction characteristics between electromagnetic clutches used as the clutch 104. Further, an abnormal sound produced by repeatedly connecting and/or disconnecting the electromagnetic clutch 104 is also prevented. The attraction characteristics of electromagnetic clutch 104 are of interest in a case where the driven gear 113 is attracted toward the clutch gear 112.

It is preferable to select the On time $\Delta L_{ON}$ and $\Delta S_{ON}$ and the OFF time $\Delta_{OFF}$ so that the fluctuation of the moving speed of the moving body 102 is such as to restrain the natural vibration of the optical system 2 in consideration of, for example, the gear pitches of the clutch gear 112 and the driven gear 113. Consequently, the natural vibration of the optical system 2 can be restrained, thereby making it possible to improve the image quality.

When the moving body 102 reaches the image region at a predetermined moving speed, the control circuit 200 continuously applies a rated voltage to the electromagnetic clutch for forward rotation 104. Consequently, the moving body 102 is moved at uniform speed by the driving force obtained from the main motor 110. If the moving body 102 reaches the terminal position in the direction L, the electromagnetic clutch for forward rotation 104 is turned off, and the control circuit 200 continuously applies the rated voltage to the electromagnetic clutch for reverse rotation 105. Therefore, the moving body 102 is moved at uniform speed in the direction R (see FIG. 2), to perform a return operation.

At the end of the return operation, the moving body 102 reaches the approach region again, beyond the position where illumination and scanning were started. At this time, the control circuit 200 applies a predetermined pulse voltage to the electromagnetic clutch for reverse rotation 105. This pulse voltage is such a voltage that the connecting force between the clutch gear 114 in the electromagnetic clutch for reverse rotation 105 and the driving gear 111 can be gradually decreased. Consequently, the moving body 102 is smoothly decelerated, to be stopped in the home position. Thereafter, the control circuit 200 turns the main motor 110 off through the output circuit 304.

As described in the foregoing, according to the present invention, at the time of starting of scanning, the pulse voltage having a relatively long ON time $\Delta L_{ON}$ is first applied to the electromagnetic clutch for forward rotation 104, thereby to reduce the clearance between the friction surfaces in the electromagnetic clutch 104 down to zero. Thereafter, the pulse voltage having constant ON time $\Delta S_{ON}$ is continuously applied to the electromagnetic clutch 104 at intervals of OFF time $\Delta_{OFF}$ such that the connecting force of the electromagnetic clutch 104 is decreased to reduce the speed of the moving body 102 once. Consequently, the electromagnetic clutch 104 is gradually connected. Therefore, it is possible to stabilize the moving speed of the moving body 102 at the rated speed over a short approach distance. Consequently, the scanning system driving device according to the present embodiment is favorable for miniaturization of the copying machine and can prevent degradation of, an image. Moreover, no complicated circuit, such as to continuously change a voltage applied to an electromagnetic clutch, is required, so that the construction is not complicated and the cost is not excessively increased.

Furthermore, as in the above described first embodiment, the scanning system driving device can be so constructed that a memory 310 (see FIG. 5), storing a plurality of types of waveforms of a pulse voltage applied to the electromagnetic clutch for forward rotation 104 or the electromagnetic clutch for reverse rotation 105, is provided for the control circuit 200, and each of the pulse waveforms is selected by, for example, a dip switch 311 (see FIG. 5). If this construction is adopted, it is possible to select by the dip switch 311 at the time of shipment of products a pulse waveform corresponding to the performance of the electromagnetic clutch 104 or 105 used in each of the products, and to select by the dip switch 311 at the time of maintenance a pulse waveform corresponding to the performance of the electromagnetic clutch 104 or 105 changed with time. Consequently, the rise characteristics of the moving speed of the moving body 102 are inhibited from varying due to differences in performance between electromagnetic clutches used as clutch 104.

Meanwhile, the pulse waveform can be stored by storing a waveform itself. However, a plurality of types of ON time $\Delta S_{ON}$ and OFF time $\Delta_{OFF}$, as well as ON time $\Delta L_{ON}$ of the first pulse P1, may be stored. In addition, the pulse waveform may be selected by an operation of a section other than the dip switch 311, for example, a keying section provided for the copying machine.

Furthermore, if the scanning system driving device is so constructed that there is provided an electromagnetic brake for stopping the movement of the scanning system, and a pulse voltage having a relatively long ON time is first applied to the electromagnetic brake when the scanning system is stopped, and then a pulse voltage having a relatively short ON time is applied thereto until the moving body 102 is stopped, it is possible to gently stop the moving body 102.

A third embodiment of the present invention will be described. Description is made by again referring to FIGS. 1 to 5 described above and further referring to FIG. 8.

Figure 8A:
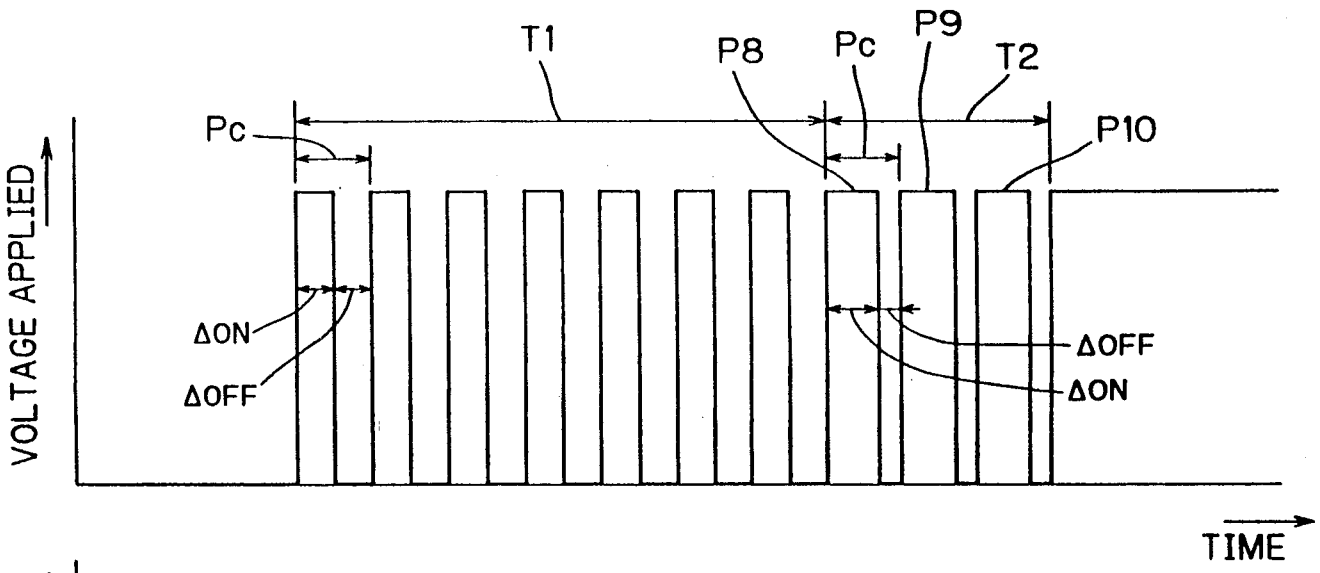
FIG. 8 (*a*) is a waveform diagram showing a voltage applied to an electromagnetic clutch at the time of starting a scanning system in a third embodiment of the present invention.
Figure 8B:
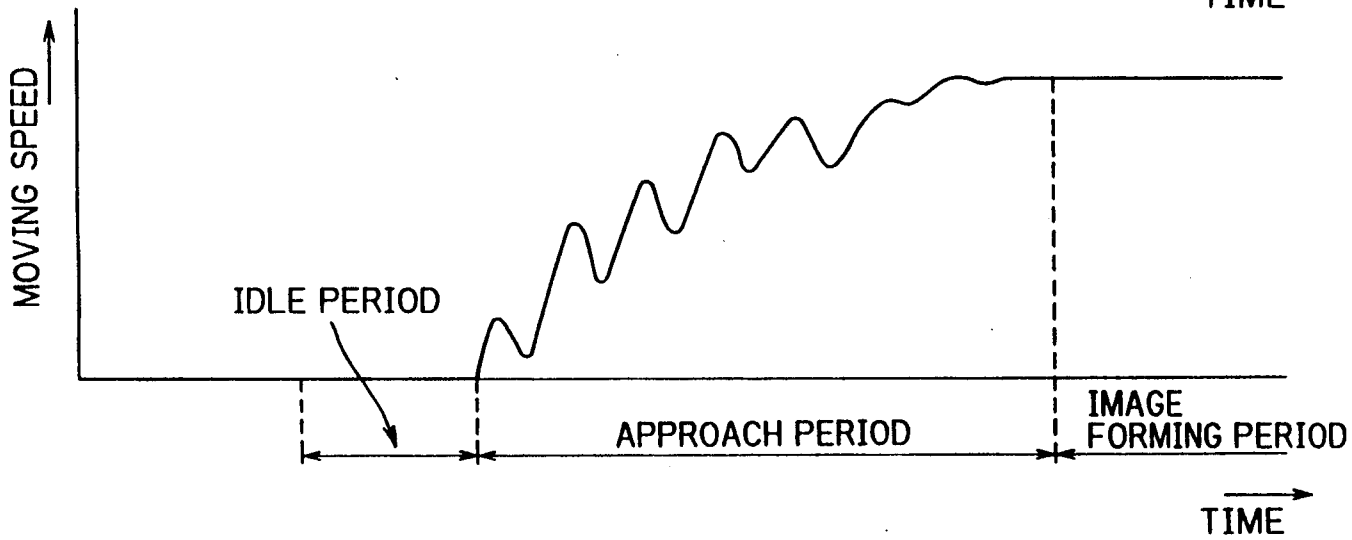

FIG. 8(*a*) is a waveform diagram showing a waveform of a voltage applied to the electromagnetic clutch for forward rotation 104 by the control circuit 200 in the early stages of the movement of the moving body 102, and FIG. 8(*b*) is a diagram showing the change with time of the moving speed of the moving body 102.

When an operator turns the print switch 301 on, an operation signal from the print switch 301 is inputted to the control circuit 200. The control circuit 200 turns the main motor 110 on through the output circuit 304 in response to the operation signal, and further applies a pulse voltage to the electromagnetic clutch for forward rotation 104 over a period extending until the moving body 102 reaches the position where illumination and scanning are started.

More specifically, as shown in FIG. 8(*a*), in a period T1, which is an idle period and the first half to the middle of an approach period, the control circuit 200 applies a pulse voltage having constant ON time $\Delta_{ON}$ to the electromagnetic clutch for forward rotation 104 at intervals of constant OFF time $\Delta_{OFF}$. The OFF time $\Delta_{OFF}$ is such time that the connecting force of the electromagnetic clutch 104 can be slightly decreased to reduce the speed of the moving body 102 once. The OFF time $\Delta_{OFF}$ in this period T1 may be a constant value or a value varying depending on the elapse of time and the position of the moving body 102. The pulse waveform shown in FIG. 8(*a*) is one example. In this example, the OFF time $\Delta_{OFF}$ in the period T1 is 5 msec and which is constant. In addition, the ON time $\Delta_{ON}$ in the period T1 is 5 msec. Such a pulse voltage is continuously applied only for a period of, for example, seven pulses.

In a period T2, which is the second half of the approach period subsequent to the period T1, a pulse voltage having ON time $\Delta_{ON}$, gradually made longer with a pulse period Pc being constant, is applied to the electromagnetic clutch for forward rotation 104. In other words, the pulse content is gradually increased. For example, in the example shown in FIG. 8(*a*) the ON time $\Delta_{ON}$ of an eighth pulse P8 is 6 msec, and OFF time $\Delta_{OFF}$ subsequent to the eighth pulse P8 is 4 msec. In addition, the ON time $\Delta_{ON}$ of a ninth pulse P9 is 7 msec, and OFF time $\Delta_{OFF}$ subsequent thereto is 3 msec. Furthermore, the ON time $\Delta_{ON}$ of a tenth pulse P10 is 8 msec, and OFF time $\Delta_{OFF}$ subsequent thereto is 2 msec.

The pulse content is thus gradually increased, thereby making it possible to completely attract the driven gear 113 toward the clutch gear 112 in the electromagnetic clutch for forward rotation 104. As a result, the electromagnetic clutch 104 can be brought into a completely connected state before the moving body 102 reaches the position where illumination and scanning are started. In the image forming period during which a document is illuminated and scanned, therefore, the electromagnetic clutch 104 is reliably in the completely connected state.

As described in the foregoing, according to the present embodiment, the OFF time $\Delta_{OFF}$ is set to have such a length that the connecting force between the clutch gear 112 and the driven gear 113 in the electromagnetic clutch for forward rotation 104 can be slightly decreased in the period T1, which is the idle period and the first half to the middle of the approach period. As shown in FIG. 8(*b*), therefore the moving speed of the moving body 102 is gradually increased without causing a large fluctuation, and is quickly stabilized. Consequently, the moving body 102 can be gently started in the direction L shown in FIG. 2. The pulse content of the pulse voltage applied to the electromagnetic clutch 104 is gradually increased in the period T2, which is the second half to the end of the approach period, is gradually increased, so that the electromagnetic clutch 104 is in the completely connected state before the moving body 102 reaches the position where illumination and scanning are started. As a result, in the image forming period subsequent to the approach period, the driving force from the main motor 110 can be stably transmitted to the moving body 102.

Furthermore, in the second half of the approach period, the electromagnetic clutch 104 leads to the completely connected state. Even when there are differences in performance, such as the magnitude of torque, between electromagnetic clutches for forward rotation 104, therefore, it is possible to stably drive the moving body 102 in the direction L (see FIG. 2), before control at the time of starting of scanning is terminated. Even when the behavior of the moving body 102 at the time of increasing the moving speed varies due to the differences in performance between electromagnetic clutches for forward rotation 104, therefore, the document can be stably scanned at uniform speed in the image forming period subsequent to the approach period.

Also in the present embodiment, it is preferable to determine the ON time $\Delta_{ON}$ and the OFF time $\Delta_{OFF}$ so that the fluctuation of the moving speed of the moving body 102 is such as to restrain the natural vibration of the optical system 2 in consideration of, for example, the gear pitches of the clutch gear 112 and the driven gear 113. Consequently, the natural vibration of the optical system 2 can be restrained, thereby to make it possible to improve the image quality.

When the moving body 102 reaches the image forming region at a predetermined moving speed, the control circuit 200 continuously applies a rated voltage to the electromagnetic clutch for forward rotation 104. Consequently, the scanning system is moved at uniform speed by the driving force obtained from the main motor 110. If the moving body 102 reaches the terminal position in the direction L, the electromagnetic clutch for forward rotation 104 is turned off, and the control circuit 200 continuously applies the rated voltage to the electromagnetic clutch for reverse rotation 105. Consequently, the moving body 102 is moved at uniform speed in the direction R (see FIG. 2), to perform a return operation.

At the end of the return operation, the moving body 102 reaches the approach region beyond the position where illumination and scanning are started. At this time, the control circuit 200 applies a predetermined pulse voltage to the electromagnetic clutch for reverse rotation 105. This pulse voltage is such that the connecting force between the clutch gear 114 in the electromagnetic clutch for reverse rotation 105 and the driving gear 111 can be gradually decreased. Consequently, the moving body 102 is smoothly decelerated, to be stopped in the home position. Thereafter, the control circuit 200 turns the main motor 110 off through the output circuit 304.

As described in the foregoing, according to the present embodiment, at the time of starting of scanning, the moving speed of the moving body 102 can be increased to the rated speed over a short approach distance and stabilized. Consequently, the scanning system driving device according to the present embodiment is favorable for miniaturization of the copying machine and can prevent degradation of an image. Moreover, a complicated circuit, such as to continuously change the voltage applied to an electromagnetic clutch, is not required, so that the construction is not complicated, and the cost is not excessively increased.

Also in the present embodiment, the scanning system driving device can be so constructed that a memory 310 (see FIG. 5), storing a plurality of types of waveforms of a pulse voltage applied to the electromagnetic clutch for forward rotation 104 or the electromagnetic clutch for reverse rotation 105, is provided for the control circuit 200, and each of the pulse waveforms is selected by, for example, a dip switch 311 (see FIG. 5), as in the above described first and second embodiments. If this construction is adopted, the rise characteristics of the moving speed of the moving body 102 can be kept constant by easily coping with the differences in performance between electromagnetic clutches used as clutches 104 or 105 and the change with time thereof.

Meanwhile, the pulse waveform can be stored by storing a waveform itself. However, a plurality of types of ON time $\Delta_{ON}$ and OFF time $\Delta_{OFF}$ sequences for each of the periods may be stored. In addition, the pulse waveform may be selected by an operation of, for example, a keying section provided for the copying machine.

A fourth embodiment of the present invention will be described. Description is made by again referring to FIGS. 1 to 5 described above and further referring to FIG. 9.

Figure 9A:
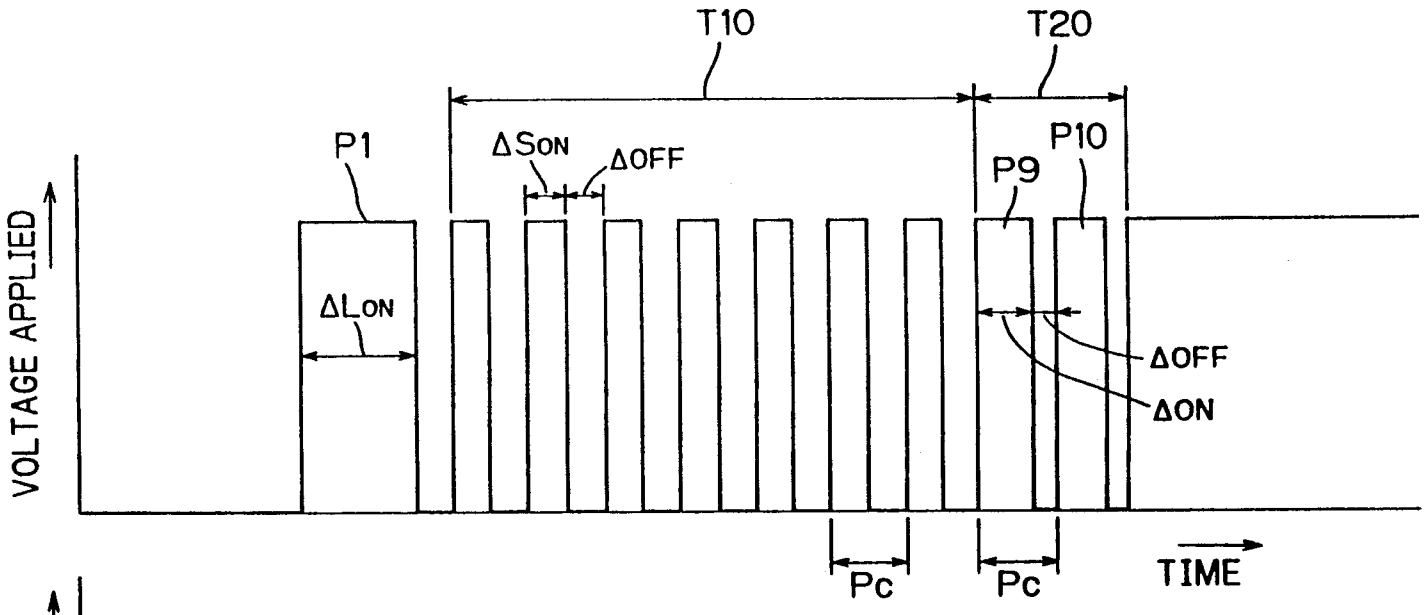
FIG. 9 (*a*) is a waveform diagram showing a voltage applied to an electromagnetic clutch at the time of starting a scanning system in a fourth embodiment of the present invention.
Figure 9B:
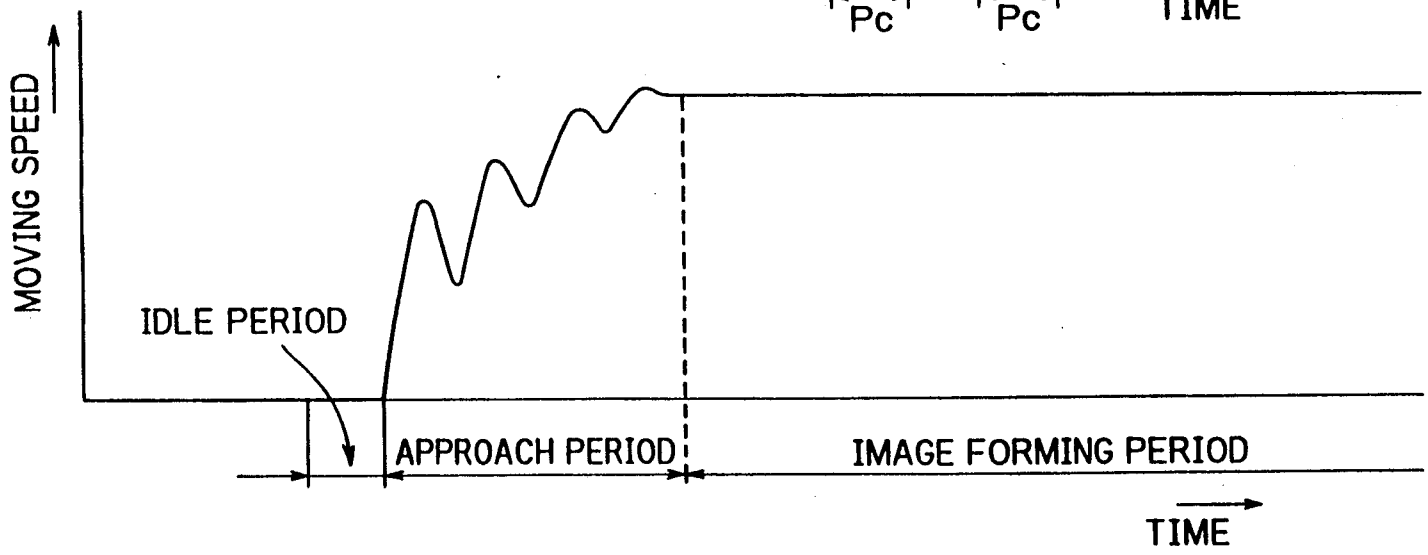

FIG. 9(*a*) is a waveform diagram showing a waveform of a voltage applied to the electromagnetic clutch for forward rotation 104 by the control circuit 200 in the early stages of the movement of the moving body 102, and FIG. 9(*b*) is a diagram showing the change with time of the moving speed of the moving body 102.

When an operator turns the print switch 301 on, an operation signal from the print switch 301 is inputted to the control circuit 200. The control circuit 200 turns the main motor 110 on through the output circuit 304 in response to the operation signal, and further applies a pulse voltage to the electromagnetic clutch for forward rotation 104 over a period extending until the moving body 102 reaches the position where illumination and scanning are started.

More specifically, as shown in FIG. 9(*b*) in a period from an idle period to the early stages of an approach period, a first pulse P1, which is a long pulse having a relatively long ON time $\Delta L_{ON}$, is applied to the electromagnetic clutch for forward rotation 104. Thereafter, during the period T10 to the early stages of the image formation period a pulse voltage having constant ON time $\Delta S_{ON}$, relatively shorter than the ON time $\Delta L_{ON}$ of the first pulse P1, is applied to the electromagnetic clutch for forward rotation 104 at intervals of OFF time $\Delta_{OFF}$. The OFF time $\Delta_{OFF}$ is such time that the connecting force of the electromagnetic clutch for forward rotation 104 can be decreased to reduce the rising speed of the scanning system once. The OFF time $\Delta_{OFF}$ may be a constant value or a value varying depending on the passage of time and the position of the moving body 102. The pulse waveform shown in FIG. 9(*a*) is one example. In this example, the OFF time $\Delta_{OFF}$ is 5 msec and is constant. In addition, the ON time $\Delta S_{ON}$ is 5 msec. Such a pulse voltage is continuously applied only for a period of, for example, seven pulses.

In a period T20 subsequent to the period T10, a pulse voltage having ON time ΔON made longer, but with the pulse period Pc being constant, is applied to the electromagnetic clutch for forward rotation 104. In other words, the pulse content is increased. For example, in the example shown in FIG. 9(*a*) the ON time $\Delta_{ON}$ of the ninth pulse P9 and the tenth pulse P10 are 6 msec, and OFF time $\Delta_{OFF}$ subsequent to these pulses P9, P10 are 3 msec. The ninth pulse and the tenth pulse respectively serve as a middle pulse.

The pulse content is thus increased in the last stage of the period applying the pulse voltage, thereby making it possible to completely attract the driven gear 113 toward the clutch gear 112 in the electromagnetic clutch for forward rotation 104. As a result, the electromagnetic clutch 104 can be brought into a completely connected state in an image forming period.

The ON time $\Delta L_{ON}$ of the first pulse P1 is set so that a clearance between friction surfaces of the clutch gear 112 and the driven gear 113 is reduced down to zero and the connecting force between the clutch gear 112 and the driven gear 113 is 20 to 50 per cent of the maximum value of the connecting force.

Consequently, the clearance between the friction surfaces of the clutch gear 112 and the driven gear 113 in the electromagnetic clutch for forward rotation 104 is first reduced down to zero by a pulse voltage corresponding to the first pulse P1. Thereafter, the pulse voltage having a relatively short ON time $\Delta S_{ON}$ is applied to the electromagnetic clutch for forward rotation 104, thereby to make it possible to gently start the moving body 102 without causing a large fluctuation of the moving speed of the moving 102. The moving speed of the moving body 102 can be increased to the rated speed over a relatively short approach distance and stabilized.

The clearance between the clutch gear 112 and the driven gear 113 in the electromagnetic clutch 104 is reduced instantaneously by the application of the first pulse P1, thereby not only shortening the approach period but also shortening the idle period. In addition, the behavior of the moving body 102 in the approach period is effectively inhibited from varying due to differences in attraction characteristics between electromagnetic clutches used as the clutch 104. Further, an abnormal sound produced by repeatedly connecting and/or disconnecting the electromagnetic clutch 104 can be also prevented.

On the other hand, the OFF time $\Delta_{OFF}$ is set to a length such that the connecting force between the clutch gear 112 and the driven gear 113 in the electromagnetic clutch for forward rotation 104 can be slightly decreased in the period T10, which is the idle period and the first half to the middle of the approach period after the first pulse P1 is applied. As shown in FIG. 9(*b*) therefore, the moving speed of the moving body 102 is gradually increased without causing a large fluctuation and is quickly stabilized. Consequently, the moving body 102 can be gently started in the direction L shown in FIG. 2. The ON time $\Delta_{ON}$ of the pulse voltage applied to the electromagnetic clutch 104 is increased in the period T20 after the period T10 is gradually increased. As a result, in the image forming period, the driving force from the main motor 110 can be stably transmitted to the moving body 102. Therefore, the document can be stably scanned at uniform speed in the image forming period.

It is preferable to determine the ON time $\Delta L_{ON}$, $\Delta_{ON}$ and $\Delta S_{ON}$ and the OFF time $\Delta_{OFF}$ so that the fluctuation of the moving speed of the moving body 102 is such as to restrain the natural vibration of the optical system 2 in consideration of, for example, the gear pitches of the clutch gear 112 and the driven gear 113. Consequently, the natural vibration of the optical system 2 can be restrained, thereby making it possible to improve the image quality.

When the moving body 102 reaches the image forming region at a predetermined moving speed, the control circuit 200 continuously applies a rated voltage to the electromagnetic clutch for forward rotation 104. Consequently, the moving body 102 is moved at a uniform speed by the driving force obtained from the main motor 110. If the moving body 102 reaches the terminal position in the direction L, the electromagnetic clutch for forward rotation 104 is turned off, and the control circuit 200 continuously applies the rated voltage to the electromagnetic clutch for reverse rotation 105. Therefore, the moving body 102 is moved at a uniform speed in the direction R (see FIG. 2), to perform a return operation.

At the end of the return operation, the moving body 102 reaches the approach region beyond the position where illumination and scanning were started. At this time, the control circuit 200 applies a predetermined pulse voltage to the electromagnetic clutch for reverse rotation 105. This pulse voltage is such that the connecting force between the clutch gear 114 in the electromagnetic clutch for reverse rotation 105 and the driving gear 111 can be gradually decreased. Consequently, the moving body 102 is smoothly decelerated, to be stopped in the home position. Thereafter, the control circuit 200 turns the main motor 110 off through the output circuit 304.

As described in the foregoing, according to the present invention, at the time of starting scanning, the pulse voltage having a relatively long ON time $\Delta L_{ON}$ is first applied to the electromagnetic clutch for forward rotation 104, thereby to reduce the clearance between the friction surfaces in the electromagnetic clutch 104 down to zero. Thereafter, the pulse voltage having constant ON time $\Delta S_{ON}$ is continuously applied to the electromagnetic clutch 104 at intervals of OFF time $\Delta_{OFF}$ such that the connecting force of the electromagnetic clutch 104 is decreased to reduce the speed of the moving body 102 once. Consequently, the electromagnetic clutch 104 is gradually connected. Therefore, it is possible to stabilize the moving speed of the moving body 102 at the rated speed at over a short approach distance. Consequently, the scanning system driving device according to the present embodiment is favorable for miniaturization of the copying machine and can prevent degradation of an image. Moreover, a complicated circuit, such as to continuously change a voltage applied to an electromagnetic clutch, is not required, so that the construction is not complicated, and the cost is not excessively increased.

Furthermore, as in the above described first embodiment, the scanning system driving device can be so constructed that a memory 310 (see FIG. 5), storing a plurality of types of waveforms of a pulse voltage applied to the electromagnetic clutch for forward rotation 104 or the electromagnetic clutch for reverse rotation 105, is provided for the control circuit 200, and each of the pulse waveforms is selected by, for example, a dip switch 311 (see FIG. 5). If this construction is adopted, it is possible to select by the dip switch 311 at the time of shipment of products a pulse waveform corresponding to the performance of the electromagnetic clutch 104 or 105 used in each of the products and to select by the dip switch 311 at the time of maintenance a pulse waveform corresponding to the performance of the electromagnetic clutch 104 or 105 changed with time. Consequently, the rise characteristics of the moving speed of the moving body 102 are inhibited from varying due to differences in performance between electromagnetic clutches used as clutch 104.

Meanwhile, the pulse waveform can be stored by storing a waveform itself. However, a plurality of types of ON time $\Delta S_{ON}$ and OFF time $\Delta_{OFF}$, as well as ON time $\Delta L_{ON}$ of the first pulse P1 and ON time $\Delta_{ON}$ of the ninth and tenth pulses P9, P10, may be stored. In addition, the pulse waveform may be selected by an operation of a section other than the dip switch 311, for example, a keying section provided for the copying machine.

Furthermore, if the scanning system driving device is so constructed that there is provided an electromagnetic brake for stopping the movement of the scanning system, and a pulse voltage having relatively long ON time is first applied to the electromagnetic brake when the scanning system is stopped, and then a pulse voltage having a relatively short ON time is applied thereto until the moving body 102 is stopped, it is possible to gently stop the moving body 102.

A fifth embodiment of the present invention will be described. Description of the present embodiment is made by again referring to FIGS. 1 to 5 described above and further referring to FIG. 10.

Figure 10A:
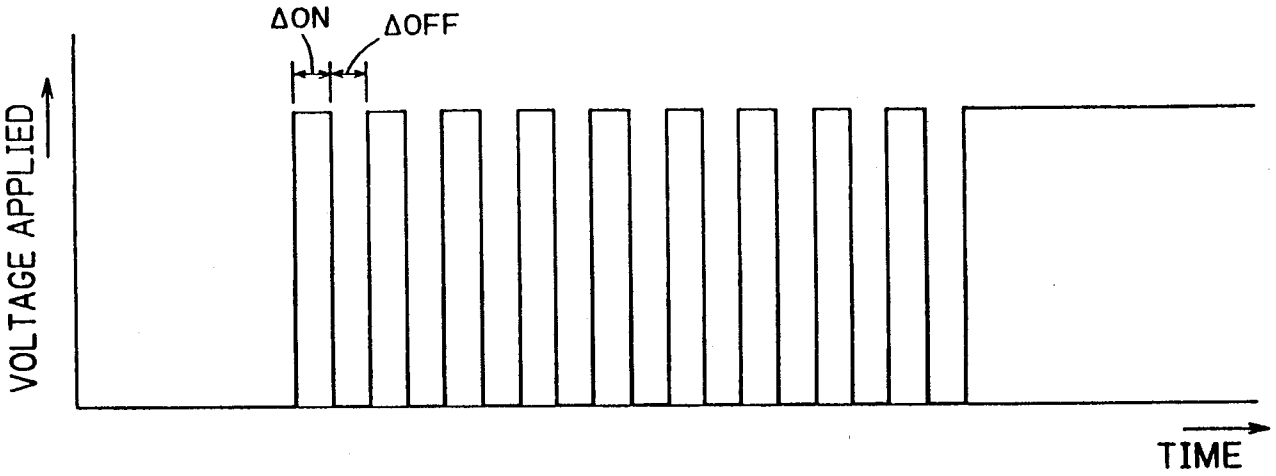
FIG. 10 (*a*) is a waveform diagram showing a voltage applied to an electromagnetic clutch at the time of starting a scanning system in a fifth embodiment of the present invention.
Figure 10B:
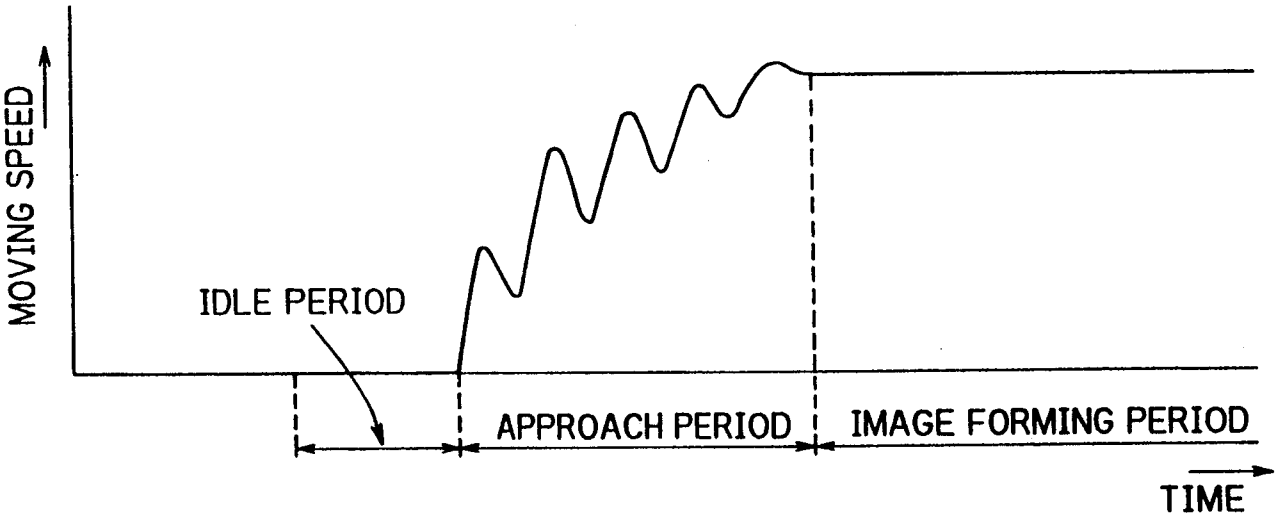
Figure 11A:
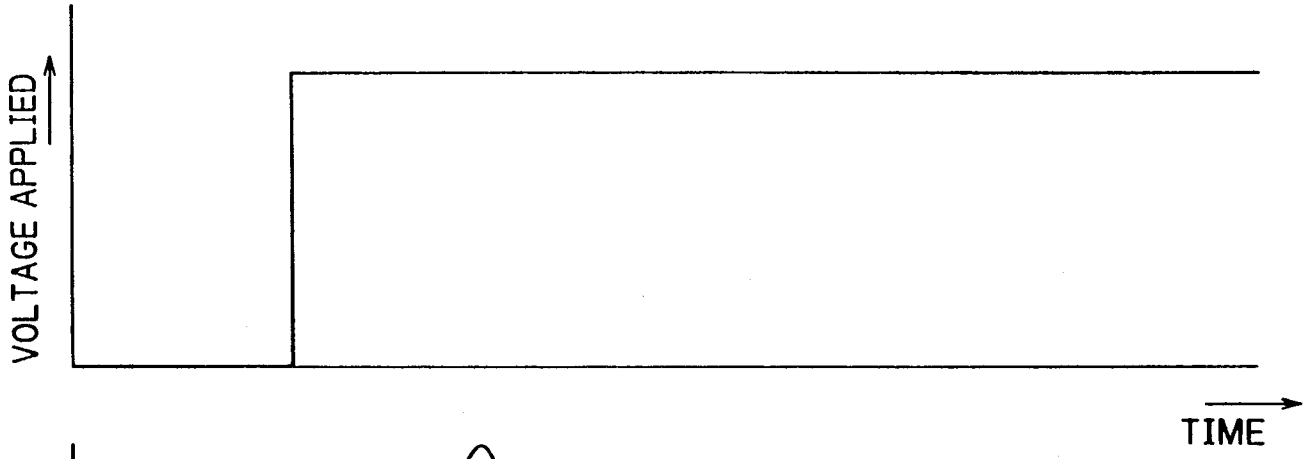
Fig. 11(a) PRIOR ART
FIG. 11 (*a*) is a waveform diagram showing a voltage applied to an electromagnetic clutch in a conventional scanning system driving device in which the approach period of a scanning system is made long, and FIG. 11 (*b*) is a diagram showing the change with time of the moving speed of the scanning system in the prior art device.
Figure 11B:
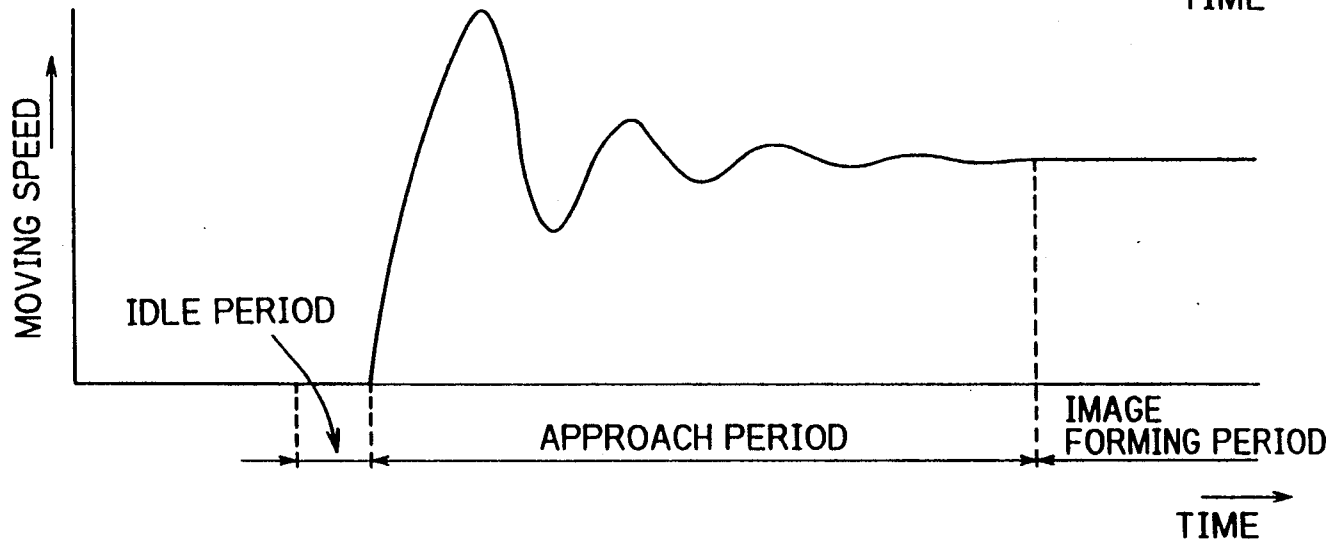
Fig. 11(b) PRIOR ART
Figure 12A:
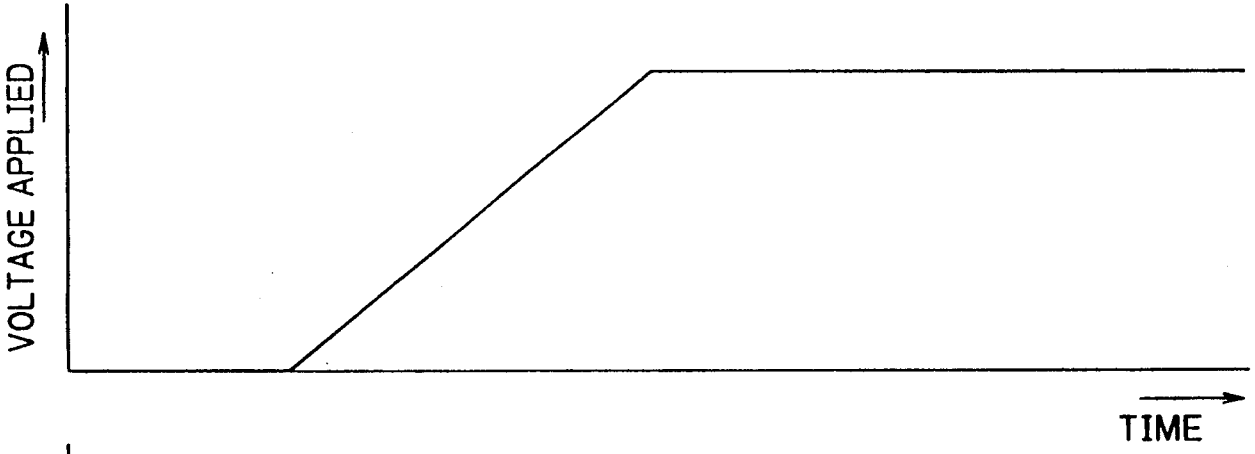
Fig. 12(a) PRIOR ART
FIG. 12 (*a*) is a waveform diagram showing a voltage applied to an electromagnetic clutch in a conventional scanning system driving device in which a voltage applied to the electromagnetic clutch is gradually increased, and FIG. 12 (*b*) is a diagram showing the change with time of the moving speed of a scanning system in the prior art device.
Figure 12B:
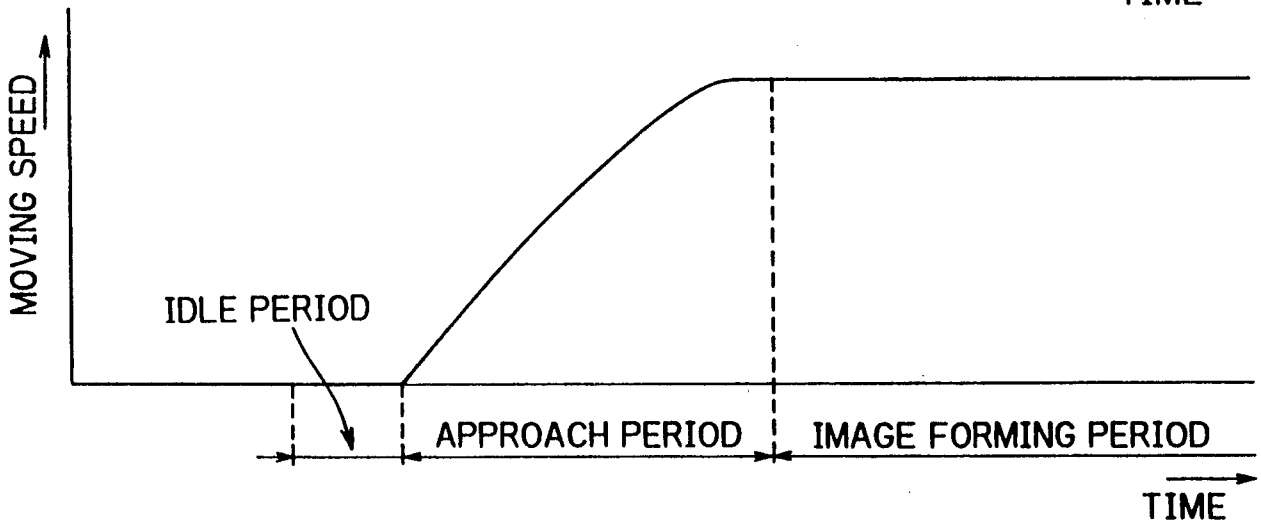
Fig. 12(b) PRIOR ART

FIG. 10(*a*) is a waveform diagram showing a waveform of a voltage applied to the electromagnetic clutch for forward rotation 104 by the control circuit 200 in the early stages of the movement of the moving body 102, and FIG. 10(*b*) is a diagram showing the change with time of the moving speed of the moving body 102.

When an operator turns the print switch 301 on, an operation signal from the print switch 301 is inputted to the control circuit 200. The control circuit 200 turns the main motor 110 on through the output circuit 304, and further applies a pulse voltage to the electromagnetic clutch for forward rotation 104 over a period extending until the moving body 102 reaches the position where illumination and scanning are started.

More specifically, as shown in FIG. 10(*a*), at the time of starting the scanning system, a pulse voltage having a constant ON time $\Delta_{ON}$ is applied to the electromagnetic clutch for forward rotation 104 at intervals of constant OFF time $\Delta_{OFF}$. The ON time $\Delta_{ON}$ and the OFF time $\Delta_{OFF}$ are respectively set to constant values such that the connecting force of the electromagnetic clutch for forward rotation 104 can be increased at uniform speed. Consequently, the pulse content of a pulse voltage applied to the electromagnetic clutch for forward rotation 104 at the time of starting the scanning system is constant.

For example, in a pulse waveform shown in FIG. 10(*a*) the OFF time $\Delta_{OFF}$ is 5 msec and is constant. In addition, the ON time $\Delta_{ON}$ is 5 msec and is constant. Such a pulse voltage is continuously applied only for a period of, for example, nine pulses.

Such control of the voltage applied to the electromagnetic clutch 104 at the time of starting the scanning system causes the connecting force between the clutch gear 112 and the driven gear 113 in the electromagnetic clutch for forward rotation 104 to be increased at a uniform speed. That is, the connecting force is not increased exponentially. Therefore, the fluctuation of the moving speed of the moving body 102 can be restrained more effectively. Consequently, the moving body 102 can be gently started. It is possible to stabilize the moving speed of the moving body 102 at a rated speed over a relatively short approach distance.

It is preferable to determine the ON time $\Delta_{ON}$ and the OFF time $\Delta_{OFF}$ so that the fluctuation of the moving speed of the moving body 102 is such as to restrain the natural vibration of the optical system 2 in consideration of, for example, the gear pitches of the clutch gear 112 and the driven gear 113. Consequently, the natural vibration of the optical system 2 can be restrained, thereby making it possible to improve the image quality.

When the moving body 102 reaches the image forming region at a predetermined moving speed, the control circuit 200 continuously applies a rated voltage to the electromagnetic clutch for forward rotation 104. Consequently, the scanning system is moved at a uniform speed by the driving force obtained from the main motor 110. If the moving body 102 reaches the terminal position in the direction L, the electromagnetic clutch for forward rotation 104 is turned off, and the control circuit 200 continuously applies the rated voltage to the electromagnetic clutch for reverse rotation 105. Consequently, the moving body 102 is moved at a uniform speed in the direction R (see FIG. 2), to perform a return operation.

At the end of the return operation, the moving body 102 reaches the approach region beyond the position where illumination and scanning were started. At this time, the control circuit 200 applies a predetermined pulse voltage to the electromagnetic clutch for reverse rotation 105. This pulse voltage is such that the connecting force between the clutch gear 114 in the electromagnetic clutch for reverse rotation 105 and the driving gear 111 can be gradually decreased. Consequently, the moving body 102 is smoothly decelerated, to be stopped in the home position. Thereafter, the control circuit 200 turns the main motor 110 off through the output circuit 304.

As described in the foregoing, according to the present invention, at the time of starting the scanning system, such a pulse voltage having a predetermined pulse content that the connecting force of the electromagnetic clutch for forward rotation 104 is increased at a uniform speed is applied to the electromagnetic clutch 104. Consequently, the moving speed of the moving body 102 can be increased to the rate speed over a short approach distance and stabilized. Consequently, the scanning system driving device according to the present embodiment is favorable for miniaturization of the copying machine and can prevent degradation of an image. Moreover, a complicated circuit such as to continuously change a voltage applied to the electromagnetic clutch, is not required, so that the construction is not complicated and the cost is not excessively increased.

Furthermore, approximately similar rise characteristics can be obtained in any clutch irrespective of the magnitude of torque.

Additionally, also in the present embodiment, the scanning system driving device can be so constructed that a memory 310 (see FIG. 5), storing a plurality of types of waveforms of a pulse voltage applied to the electromagnetic clutch for forward rotation 104 or the electromagnetic clutch for reverse rotation 105, is provided for the control circuit 200, and each of the pulse waveforms is selected by, for example, a dip switch 311 (see FIG. 5), as in the above mentioned first to fourth embodiments. If this construction is adopted, it is possible to easily cope with differences in performance between electromagnetic clutches used as clutches 104 or 105 and the change with time thereof.

Meanwhile, the pulse waveform can be stored by storing a waveform itself. However, a plurality of types of ON times $\Delta ON$ and OFF times $\Delta_{OFF}$ may be stored. In addition, the pulse waveform may be selected by an operation of, for example, a keying section provided for the copying machine.

Furthermore, if the scanning system driving device is so constructed that an electromagnetic brake for stopping the movement of the scanning system is provided, and a pulse voltage having a constant pulse content is applied to the electromagnetic brake, the moving body 102 can be gently stopped.

Although in the above described first to fifth embodiments, description was made by taking an analog copying machine as an example, the present invention is also applicable to a digital copying machine for reading an image by an image sensor, subjecting the image read to digital processing, and forming a copy image of a document on the basis of data obtained by the digital processing. In addition, the present invention is not limited to a copying machine. For example, the present invention is widely applicable to an apparatus for optically reading a document such as an image scanner. Furthermore, the present invention is also applicable to an arbitrary scanning system other than a scanning system for scanning a document.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A scanning system driving device comprising:

a scanning system having a predetermined inertial mass;

a driving source for outputting a driving force for driving said scanning system at constant speed;

a first electromagnetic clutch for transmitting driving force from said driving source to said scanning system, said first electromagnetic clutch capable of being brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state varying depending on the magnitude of the average applied voltage per unit time;

power supply means for generating a rated voltage to be applied to said first electromagnetic clutch, the rated voltage being a voltage which is continuously applied to said first electromagnetic clutch for not less than a predetermined time to allow said first electromagnetic clutch to be brought into the completely connected state; and control means for applying the rated voltage generated by said power supply means to said first electromagnetic clutch in the form of pulses at intervals having an OFF time such that the connecting force of said first electromagnetic clutch can be decreased to reduce the speed of said scanning system once during the time of starting of scanning by said scanning system to gradually increase the connecting force of said electromagnetic clutch.

2. The scanning system driving device according to claim 1, wherein:

said scanning system includes means for illuminating a document during scanning thereof.

3. The scanning system driving device according to claim 2, wherein:

said scanning system includes an optical system and means for driving aid optical system and said illuminating means, while retaining the document stationary.

4. The scanning system driving device according to claim 2, wherein:

said control means applies the rated voltage in the form of pulses having a pulse width and intervals of OFF time during the time of starting of scanning by said scanning system such that the scanning system reaches a predetermined speed before the illumination of the document by said illumination means.

5. The scanning system driving device according to claim 1, wherein:

said control means applies the rated voltage in the form of pulses having a constant OFF time such that the connecting force of said first electromagnetic clutch can be decreased to reduce the speed of the scanning system once.

6. The scanning system driving device according to claim 1, wherein:

said control means applies the rated voltage in the form of pulsing having a pulse width and intervals of OFF time during the time of starting of scanning by said scanning system such that the natural vibration of said scanning system can be restrained.

7. The scanning system driving device according to claim 1, wherein;

said control means continuously applies the rated voltage to said first electromagnetic clutch after the speed of said scanning system is stabilized at a predetermined speed.

8. The scanning system driving device according to claim 1, wherein:

said control means includes pulse waveform setting means for setting a variable pulse width and intervals of OFF time during the time of starting of scanning by said scanning system, to set a waveform of a variable pulse voltage applied to said first electromagnetic clutch.

9. The scanning system driving device according to claim 8, wherein said pulse waveform setting means comprises:

storing means for storing a plurality of types of waveforms of the pulse voltage to be applied to said first electromagnetic clutch during the time of starting of scanning by said scanning system; and means for selecting one of the types of waveforms of the pulse voltage from the plurality of types of waveforms stored in said storing means.

10. The scanning system driving device according to claim 1, further comprising:

a second electromagnetic clutch for transmitting driving force from said driving source to said scanning system so that said scanning system is driven in the direction opposite to the direction driven by the driving force applied through said first electromagnetic clutch, brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state of said second electromagnetic clutch varying depending on the magnitude of the average applied voltage per unit time; and wherein said control means includes means responsive to said scanning system reaching a terminal position of scanning, for continuously applying the rated voltage generated by said power supply to said second electromagnetic clutch, and means for applying the rated voltage generated by said power supply means to said second electromagnetic clutch in the form of pulses during a period immediately before said scanning system has returned to an initial position.

11. A scanning system driving device comprising:

a scanning system having a predetermined inertial mass;

a driving source for outputting a driving force for driving said scanning system at constant speed;

a first electromagnetic clutch for transmitting driving force from said driving source to said scanning system, said first electromagnetic clutch capable of being brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state varying depending on the magnitude of the average applied voltage per unit time;

power supply means for generating a rated voltage to be applied to said first electromagnetic clutch, the rated voltage being a voltage which is continuously applied to said first electromagnetic clutch for not less than a predetermined time to allow said first electromagnetic clutch to be brought into the completely connected state; and control means for applying the rated voltage generated by said power supply means to said first electromagnetic clutch in the form of pulses, with a relatively long pulse width during an initial predetermined period after scanning by said scanning system is started, and applying said rated voltage to said first electromagnetic clutch in the form of pulses with a relatively short pulse width until the speed of said scanning system is increased to a predetermined speed after said predetermined period, to gradually increase the connecting force of said electromagnetic clutch.

12. The scanning system driving device according to claim 11, wherein:

said scanning system includes means for illuminating a document during scanning thereof.

13. The scanning system driving device according to claim 12, wherein:

said scanning system includes an optical system and means for driving said optical system and said illuminating means, while retaining the document stationary.

14. The scanning system driving device according to claim 12, wherein:

said control means applies the rated voltage to said first electromagnetic clutch during the time of starting of scanning by said scanning system in the form of pulses having a pulse width such that the speed of said scanning system reaches the predetermined speed before the illumination of the document by said illuminating means.

15. The scanning system driving device according to claim 11, wherein:

said control means applies the rated voltage in the form of pulses during the time of starting of scanning by the scanning system, the first pulse having the relatively long pulse width and subsequent pulses having the relatively short pulse width, the pulses being separated by intervals of predetermined OFF time, until the speed of said scanning system is increased to a predetermined speed.

16. The scanning system driving device according to claim 15, wherein:

the pulse width of the first pulse is set so that a connecting force 20 to 50 per cent of the maximum connecting force of said first electromagnetic clutch is obtained by applying the first pulse to said first electromagnetic clutch.

17. The scanning system driving device according to claim 15, wherein:

the intervals of OFF time when the subsequent pulses are applied to said first electromagnetic clutch are such that the connecting force of said first electromagnetic clutch can be decreased to reduce the speed of said scanning system once.

18. The scanning system driving device according to claim 11, wherein:

said control means applies the rated voltage to said first electromagnetic clutch during the time of starting of scanning by said scanning system as a waveform of voltage pulses having a pulse width and intervals of OFF time such that the natural vibration of said scanning system can be restrained.

19. The scanning system driving device according to claim 11, wherein;

said control means continuously applies the rated voltage to said first electromagnetic clutch after the speed of said scanning system is stabilized at a predetermined speed.

20. The scanning system driving device according to claim 11, wherein:

said control means includes pulse waveform setting means for setting a variable waveform of pulse voltage during the time of starting of scanning by said scanning system.

21. The scanning system driving device according to claim 20, wherein said pulse waveform setting means comprises:

storing means storing a plurality of types of waveforms of the pulse voltage to be applied to said first electromagnetic clutch during the time of starting of scanning by said scanning system; and means for selecting one of the types of waveforms of the pulse voltage from the plurality of types of waveforms stored in said storing means.

22. The scanning system driving device according to claim 11, further comprising:

a second electromagnetic clutch for transmitting driving force from said driving source to said scanning system so that said scanning system is driven in the direction opposite to the direction driven by the driving force applied through said first electromagnetic clutch, brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state of said second electromagnetic clutch varying depending on the magnitude of the average applied voltage per unit time; and wherein said control means includes means responsive to said scanning system reaching a terminal position of scanning, for continuously applying the rated voltage generated by said power supply to said second electromagnetic clutch, and means for applying the rated voltage generated by said power supply means to said second electromagnetic clutch in the form of pulses during a period immediately before said scanning system has returned to an initial position.

23. A scanning system driving device comprising:

a scanning system having a predetermined inertial mass;

a driving source for outputting a driving force for driving said scanning system at constant speed;

a first electromagnetic clutch for transmitting driving force from said driving source to said scanning system, said first electromagnetic clutch capable of being brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state varying depending on the magnitude of the average applied voltage per unit time;

power supply means for generating a rated voltage to be applied to said first electromagnetic clutch, the rated voltage being a voltage which is continuously applied to said first electromagnetic clutch for not less than a predetermined time to allow said first electromagnetic clutch to be brought into the completely connected state; and control means for applying the rated voltage generated by said power supply means to said first electromagnetic clutch in the form of pulses with a predetermined pulse content during the time of starting of scanning by said scanning system to gradually increase the connecting force thereof, and subsequently with an increasing pulse content with the passage of time.

24. The scanning system driving device according to claim 23, wherein:

said scanning system includes means for illuminating a document during scanning thereof.

25. The scanning system driving device according to claim 24, wherein:

said scanning system includes an optical system and means for driving said optical system and said illuminating means, while retaining the document stationary.

26. The scanning system driving device according to claim 24, wherein:

said control means sets the pulse content so that the speed of said scanning system reaches a predetermined speed before the illumination of the document is started.

27. The scanning system driving device according to claim 24, wherein:

said control means increases the pulse content so that the connection of said first electromagnetic clutch is completely achieved before said scanning system reaches a position where the illumination of the document is started.

28. The scanning system driving device according to claim 24, wherein:

said control means increases the pulse content so that the speed of said scanning system reaches a predetermined speed before the illuminating of the document is started.

29. The scanning system driving device according to claim 23, wherein;

said control means maintains the pulse period constant and changes only the pulse content..

30. The scanning system driving device according to claim 23, wherein:

said control means maintains the pulse content constant during an initial predetermined period after scanning by said scanning system is started and gradually increases the pulse content after passage of a predetermined period.

31. The scanning system driving device according to claim 23, wherein:

said control means applies the rated voltage to said first electromagnetic clutch during the time of starting scanning by said scanning system as a waveform of voltage pulses having a pulse width and intervals of OFF time such that the natural vibration of said scanning system can be restrained.

32. The scanning system driving device according to claim 23, wherein:

said control means continuously applies the rated voltage to said first electromagnetic clutch after the speed of said scanning system is stabilized at a predetermined speed.

33. The scanning system driving device according to claim 23, wherein:

said control means includes pulse waveform setting means for setting a variable waveform of pulse voltage during the time of starting of scanning by said scanning system.

34. The scanning system driving device according to claim 33, wherein said pulse waveform setting means comprises:

storing means for storing a plurality of types of waveforms of the pulse voltage to be applied to said first electromagnetic clutch during the time of starting of scanning by said scanning system; and means for selecting one of the types of waveforms of the pulse voltage from the plurality of types of waveforms stored in said storing means.

35. The scanning system driving device according to claim 23, further comprising:

a second electromagnetic clutch for transmitting driving force from said driving source to said scanning system so that said scanning system is driven in the direction opposite to the direction driven by the driving force applied through said first electromagnetic clutch, brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state of said second electromagnetic clutch varying depending on the magnitude of the average applied voltage per unit time; and wherein said control means includes means responsive to said scanning system reaching a terminal position of scanning, for continuously applying the rated voltage generated by said power supply to said second electromagnetic clutch, and means for applying the rated voltage generated by said power supply means to said second electromagnetic clutch in the form of pulses during a period immediately before said scanning system has returned to an initial position.

36. A scanning system driving device comprising:

a scanning system having a predetermined inertial mass;

a driving source for outputting a driving force for driving said scanning system at constant speed;

a first electromagnetic clutch for transmitting driving force from said driving source to said scanning system, said first electromagnetic clutch capable of being brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state varying depending on the magnitude of the average applied voltage per unit time;

power supply means for generating a rated voltage to be applied to said first electromagnetic clutch, the rated voltage being a voltage which is continuously applied to said first electromagnetic clutch for not less than a predetermined time to allow said first electromagnetic clutch to be brought into the completely connected state; and control means for applying the rated voltage generated by said power supply means to said first electromagnetic clutch in the form of pulses with a relatively long pulse width during an early stage of scanning by said scanning system, and then applying the rated voltage generated by said power supply to said first electromagnetic clutch in the form of pulses with a relatively short pulse width during subsequent scanning by said scanning system, to gradually increase the connecting force of said first electromagnetic clutch during the time of starting of scanning by said scanning system, and later increasing the pulse content of the pulses with the passage of time.

37. The scanning system driving device according to claim 36, wherein:

said scanning system includes means for illuminating a document during scanning thereof.

38. The scanning system driving device according to claim 37, wherein:

said scanning system includes an optical system and means for driving said optical system and said illuminating means while retaining the document stationary.

39. The scanning system driving device according to claim 37, wherein:

said control means sets the pulse width of the rated voltage during the time of starting of scanning by said scanning system so that the speed of the scanning system reaches a predetermined speed before the illumination of the document is started.

40. The scanning system driving device according to claim 36, wherein:

said control means maintains the pulse period constant as the pulse content is increased with the passage of time.

41. A scanning system driving device according to claim 36, wherein:

said control means applies the rated voltage in the form of a first pulse having the relatively long pulse width, followed by a plurality of short pulses having the relatively short pulse width and then at least one middle width pulse, having a pulse width longer than that of the short pulses and shorter than that of the long pulse.

42. The scanning system driving device according to claim 41, wherein:

the pure width of said long pulse causes a connecting force 20 to 50 per cent of the maximum connecting force of said electromagnetic clutch to be obtained.

43. A scanning system driving device according to claim 41, wherein:

the OFF time interval of the short pulses is set so as to decrease the connecting force of said first electromagnetic clutch to reduce the scanning speed of said scanning system.

44. The scanning system driving device according to claim 36, wherein:

said control means applies the rated voltage to said first electromagnetic clutch during the time of starting scanning by said scanning system as a waveform of voltage pulses having a pulse width and intervals of OFF time such that the natural vibration of said scanning system can be restrained.

45. The scanning system driving device according to claim 36, wherein;

said control means continuously applies the rated voltage to said first electromagnetic clutch after the speed of said scanning system is stabilized at a predetermined speed.

46. The scanning system driving device according to claim 36, wherein:

said control means includes pulse waveform setting means for setting a variable waveform of pulse voltage during the time of starting of scanning by said scanning system.

47. The scanning system driving device according to claim 46, wherein said pulse waveform setting means comprises:

storing means for storing a plurality of types of waveforms of the pulse voltage to be applied to said first electromagnetic clutch during the time of starting of scanning by said scanning system; and means for selecting one of the types of waveforms of the pulse voltage from the plurality of types of waveforms stored in said storing means.

48. The scanning system driving device according to claim 36, further comprising:

a second electromagnetic clutch for transmitting driving force from said driving source to said scanning system so that said scanning system is driven in the direction opposite to the direction driven by the driving force applied through said first electromagnetic clutch, brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state of said second electromagnetic clutch varying depending on the magnitude of the average applied voltage per unit time; and wherein said control means includes means responsive to said scanning means reaching a terminal position of scanning, for continuously applying the rated voltage generated by said power supply to said second electromagnetic clutch, and means for applying the rated voltage generated by said power supply means to said second electromagnetic clutch in the form of pulses during a period immediately before said scanning system has returned to an initial position.

49. A scanning system driving device comprising:

a scanning system having a predetermined inertial means;

a driving source for outputting a driving force for driving said scanning system at constant speed;

a first electromagnetic clutch for transmitting driving force from said driving source to said scanning system, said first electromagnetic clutch capable of being brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state varying depending on the magnitude of the average applied voltage per unit time;

power supply means for generating a rated voltage to be applied to said first electromagnetic clutch, the rated voltage being a voltage which is continuously applied to said first electromagnetic clutch for not less than a predetermined time to allow said first electromagnetic clutch to be brought into the completely connected state; and control means for applying the rated voltage generated by said power supply means to said first electromagnetic clutch in the form of pulses having a pulse content such that the connecting force of said first electromagnetic clutch is increased at uniform speed during the time of starting of scanning by said scanning system.

50. The scanning system driving device according to claim 49, wherein:

said scanning system includes means for illuminating a document during scanning thereof.

51. The scanning system driving device according to claim 50, wherein:

said scanning system includes an optical system and means for driving said optical system and said illuminating means, while retaining the document stationary.

52. The scanning system driving device according to claim 50, wherein:

said control means sets the pulse content so that the speed of said scanning system reaches a predetermined speed before the illumination of the document is started.

53. The scanning system driving device according to claim 49, wherein:

said control means applies the rated voltage generated by said power supply in the form of pulses of constant ON time and at intervals of constant OFF time during the time of starting of scanning by said scanning system.

54. The scanning system driving device according to claim 49, wherein:

said control means sets the pulse content so that the natural vibration of the scanning system can be restrained.

55. The scanning system driving device according to claim 49, wherein:

said control means continuously applies the rated voltage to said first electromagnetic clutch after the speed of said scanning system is stabilized at a predetermined speed.

56. The scanning system driving device according to claim 49, wherein:

said control means includes pulse waveform setting means for setting a variable waveform of the pulse voltage applied during the time of starting of scanning by said scanning system.

57. The scanning system driving device according to claim 56, wherein said pulse waveform setting means comprises:

storing means for storing a plurality of types of waveforms of the pulse voltage to be applied to said first electromagnetic clutch during the time of starting of scanning by said scanning system, and means for selecting one of the types of waveforms of the pulse voltage from the plurality of types of waveforms stored in said storing means.

58. The scanning system driving device according to claim 49, further comprising:

a second electromagnetic clutch for transmitting driving force from said driving source to said scanning system so that said scanning system is driven in the direction opposite to the direction driven by the driving force applied through said first electromagnetic clutch, brought into a half connected state, intermediate a disconnected state in which the driving force from said driving source is not entirely transmitted to said scanning system and a completely connected state in which the driving force from said driving source is directly transmitted to said scanning system, depending on the relationship among a connecting force thereof, the inertial mass of said scanning system and the driving force from said driving source, the connecting force in the half connected state of said second electromagnetic clutch varying depending on the magnitude of the average applied voltage per unit time; and wherein said control means includes means responsive to said scanning means reaching a terminal position of scanning, for continuously applying the rated voltage generated by said power supply to said second electromagnetic clutch, and means for applying the rated voltage generated by said power supply means to said second electromagnetic clutch in the form of pulses during a period immediately before said scanning system has returned to an initial position.

* * * * *